US009074608B2

(12) United States Patent
Bertels

(10) Patent No.: US 9,074,608 B2
(45) Date of Patent: Jul. 7, 2015

(54) ROTATION DEVICE

(75) Inventor: Augustinus Wilhelmus Maria Bertels, Doorwerth (NL)

(73) Assignee: Bronswerk Radiax Technology B.V., Nijkerk (NL)

( * ) Notice: Subject to any disclaimer, the term of this patent is extended or adjusted under 35 U.S.C. 154(b) by 1168 days.

(21) Appl. No.: 12/936,006

(22) PCT Filed: Apr. 2, 2009

(86) PCT No.: PCT/NL2009/000079

§ 371 (c)(1),
(2), (4) Date: Dec. 22, 2010

(87) PCT Pub. No.: WO2009/123442

PCT Pub. Date: Oct. 8, 2009

(65) Prior Publication Data

US 2011/0097190 A1 Apr. 28, 2011

(30) Foreign Application Priority Data

Apr. 2, 2008 (NL) ..... 2001435

(51) Int. Cl.
*F04D 29/28* (2006.01)
*F04D 29/22* (2006.01)

(52) U.S. Cl.
CPC ..... *F04D 29/284* (2013.01); *F04D 29/2222* (2013.01); *F04D 29/286* (2013.01)

(58) Field of Classification Search
CPC . F04D 29/2222; F04D 29/284; F04D 29/285; F04D 29/286; F04D 29/4266; F04D 29/44; F04D 29/444; F04D 29/448
USPC ..... 415/77, 79, 83, 89, 199.1, 199.2, 199.3, 415/199.6, 206, 211.2, 220, 221, 213.1, 415/214.1, 215.1, 901
See application file for complete search history.

(56) References Cited

U.S. PATENT DOCUMENTS

| | | | | |
|---|---|---|---|---|
| 3,102,680 | A * | 9/1963 | Fogleman et al. | 415/172.1 |
| 3,269,324 | A * | 8/1966 | Van Atta | 415/199.2 |
| 3,398,694 | A * | 8/1968 | Lerch | 417/366 |
| 3,751,178 | A * | 8/1973 | Paugh et al. | 415/199.1 |
| 3,975,117 | A * | 8/1976 | Carter | 417/370 |
| 6,565,315 | B1 * | 5/2003 | Bertels et al. | 415/206 |

FOREIGN PATENT DOCUMENTS

| | | |
|---|---|---|
| EP | 1102936 B1 | 2/2004 |
| NL | 1009759 | 7/1998 |

* cited by examiner

*Primary Examiner* — Dwayne J White
*Assistant Examiner* — Fyan Ellis
(74) *Attorney, Agent, or Firm* — The Webb Law Firm

(57) ABSTRACT

The invention relates to a rotation device, such as a pump or a hydromotor of the rotating type, wherein a rotation-symmetrical rotor bounds at least two rotor channels together with radial baffles. The rotor comprises two generally goblet-shaped dishes, the innermost dish of which is stiffened by a first stiffening plate which has a peripheral widening, for instance branches in its peripheral zone into at least two rings which are rigidly connected with at least two respective bent peripheral edges, substantially over the whole outer surfaces thereof, to the inner surface of the peripheral edge of the relevant dish such that the stiffness of the peripheral edge of the dish is increased.

25 Claims, 24 Drawing Sheets

ROTATION DEVICE

The invention relates to a rotation device, such as a pump, a turbine or a hydromotor, comprising:

(a) a housing with a central, substantially axial first medium passage and at least one substantially axial second medium passage;

(b) a rotor shaft which extends in this housing and outside this housing and which is rotatably mounted relative to this housing and supports a rotor accommodated in this housing, which rotor branches with a central third medium passage into a number of angularly equidistant rotor channels, each extending in a respectively at least more or less flat main plane perpendicularly of the rotation axis of the rotor from the third medium passage to a respective fourth medium passage, wherein the end zone of the third medium passage and the end zone of the fourth medium passage each extend in at least more or less axial direction and each rotor channel has a curved form, for instance a general U-shape or a general S-shape, has a middle part which extends in a direction with at least a considerable radial component, and each rotor channel has a flow tube cross-sectional area, i.e. a section transversely of each local main direction, which increases in the direction from the third medium passage to the fourth medium passage from a relative value of 1 to a relative value of at least 4;

(c) a stator accommodated in this housing, comprising:

(c.1) a first central body which has a substantially rotation-symmetrical, for instance at least more or less cylindrical, at least more or less conical, curved or hybrid formed outer surface with a smooth form which, together with an inner surface of the housing, bounds a generally substantially rotation-symmetrical, for instance cylindrical medium passage space with a radial dimension of a maximum of 0.4 times the radius of said outer surface, in which medium passage space are accommodated a number of angularly equidistant stator baffles which in pairs bound stator channels, which stator baffles each have at their end zone directed toward the rotor and forming a fifth medium passage (24) a direction varying substantially, in particular at least 60°, from the axial direction, and at their other end zone forming a sixth medium passage a direction varying little, in particular by a maximum of 15°, from the axial direction, which fifth medium passages connect for medium flow in substantially axial direction to the fourth medium passages and are placed at substantially the same radial positions, and which sixth medium passages are connected to the at least one second medium passage;

(c.2) a second central body connecting to the first central body, wherein between the sixth medium passage and the at least one second medium passage there extends at least one manifold channel extending in the direction from the sixth medium passages to the at least one second medium passage and bounded by the outer surface of the second central body (23) and the cylindrical inner surface of the housing;

wherein a general medium throughflow path is defined between the first medium passage and the at least one second medium passage through respectively the first medium passage, the third medium passages, the rotor channels, the fourth medium passages, the stator channels, the sixth medium passages, the or each manifold channel, the second medium passages, and vice versa, with substantially smooth and continuous transitions between said parts during operation;

wherein the structure is such that during operation there is a mutual force coupling between the rotation of the rotor, and thus the rotation of the shaft, on the one hand and the pressure in the medium flowing through said medium throughflow path;

wherein the rotor comprises two rotation-symmetrical, generally goblet-shaped dishes, i.e. a first dish adjoining the first medium passage, and a second dish disposed at a position remote from the first medium passage, which two dishes, together with baffles also serving as spacers, bound the rotor channels, the axes of said dishes coinciding with the rotation axis of the rotor;

wherein the dishes and the baffles consist of sheet material, for instance optionally fibre-reinforced plastic, an aluminium (alloy), a titanium (alloy), stainless steel or spring steel; and wherein the second dish is stiffened by stiffening means which comprise:

- a first stiffening plate extending in a plane perpendicularly of the axis of the rotor, which stiffening plate is connected in tensively strong manner on one side to the rotor shaft and on the other side to the outer peripheral edge of the second dish extending in at least more or less axial direction; and
- a shoring structure connected on one side to the rotor shaft and on the other to the middle part of the second dish, this middle part extending with at least a considerable radial component.

Such a rotation device is known from NL-C-1009759 and the Europe patent application EP-A-1 102 936 based thereon.

The known device is found to have the problem at the mechanically realizable very high rotation speeds that the roughly goblet-shaped rotor dishes display, as a result of the very high centrifugal forces which occur, a radial and an axial deformation, particularly at their free peripheral edges, such that this can have an adverse effect on the operation of the rotation device. For instance when operating as pump, wherein the rotor is driven by a motor, the free end edges of the dishes must extend some distance inside the annular inlet space of the stator. As a consequence of the described elastic deformation at extremely high rotation speeds there is the risk of the rotor end edges coming into contact with the stator. This cannot be permitted and therefore imposes a limit on the maximum achievable rotation speed. The rotation speed can nevertheless be increased for mechanical reasons because the materials applied, in particular suitable types of metal, can be loaded to higher rotation speeds and corresponding speeds of revolution without exceeding their elastic limit.

It is for this reason that the invention has for its object to embody a device of the known type such that at the highest achievable rotation speed to be determined on materials science basis the radial displacement of the end edges of the dishes lies within a predetermined tolerance value, in accordance with a maximum allowable elastic deformation, corresponding to the distance between the peripheral edge of the relevant outer rotor dish and, located some distance outside it, the part of the relevant outer inlet wall of the stator.

On the basis of these considerations, the invention provides a rotation device of the described type which has the feature that the first stiffening plate has in its peripheral edge zone an annular widening, of which the outer surface located radially furthest outward is connected rigidly to the inner surface of the second dish such that the stiffness of the peripheral edge of the dish is increased.

This rotation device can for instance have the special feature that the first stiffening plate branches in its peripheral edge zone into at least two rings which, with at least two respective bent peripheral edges substantially over the whole outer surfaces thereof, are rigidly connected to the inner surface of the peripheral edge of the second dish.

It is noted here that from said publication NL-C-1009759, in particular FIG. 2 thereof, a rotation device with a rotor is known, the inner dish of which is stiffened with a stiffening plate and a number of truncated conical shores. The stiffening plate extends from the shaft of the rotor and is connected to the associated dish.

The shores have a generally zigzag structure in the form of rotation-symmetrical plates, so in the manner of truncated cone shapes, present between stiffening plate and the dish and connected thereto. Mention is made of the use of metal, for instance stainless steel or spring steel.

Despite this apparently very rigid construction, this prior art rotor structure is found not to meet the extreme demands to be made according to the invention of the freedom from elastic deformation of the rotor. It is found particularly that, while a radial stiffening has certainly occurred, the centrifugal forces result in the occurrence of a bending moment, as a result of which the end edge in question moves away from the stator inlet, with the subsequent result that a radial deformation component also occurs. As a result of this structure the desired extremely high rotation speed is found not to be realizable with the known structure.

The invention is based on the insight that it is essential not only to strengthen the peripheral edge of the inner dish in radial direction but also to increase the stiffness, in particular the bending stiffness, of the peripheral edge of the dish. This wish is now realized with the described structure according to the invention, wherein use is made of two, three or even more rings which are connected in tensively strong manner to the inner zone of the first stiffening plate, and the peripheral edges of which are bent through an angle corresponding to the local angle of inclination of the peripheral edge. In this way a very light, low-deformation and particularly stiff structure is obtained by means of welding, in particular spot-welding. It must be seen as very important here that at the "forking point", so the zone where the rings come together, therefore at a position lying radially closer to the rotor axis, the relevant zone is substantially only under strain of tension, wherein it is necessary to avoid as far as possible the zone also being under strain of bending.

When for instance three rings are used, the middle ring can extend exactly in transverse direction relative to the rotor axis, while the other two rings, which have a truncated conical form, are dimensioned such that the stated criterion is met. This has been found in practice to result in such an improvement in the technical properties of the rotor that even the extremely high rotation speeds achievable on materials science basis can be realized. As a result the rotation device according to the invention can be utilized over a substantially greater range of rotation speeds than the known rotation device.

According to an important aspect of the invention, the device has the special feature that the peripheral edges of the least two rings at least substantially connect to each other. This achieves that the peripheral edges together form a more or less continuous annular stiffening and strengthening ring, and together make a further contribution toward stiffening the peripheral edge of the relevant dish.

It has been found that, even with the above described structure according to the invention, there is still the risk of the goblet-shaped dish undergoing a certain, albeit small, elastic deformation. This deformation occurs roughly in the middle, or the annular inflection point zone of the goblet-shaped dish. This deformation, which has an axial and bending component as well as a radial one, can be almost wholly prevented with a structure in which the shoring structure comprises:

a second stiffening plate extending in a plane perpendicularly of the axis of the rotor, which second stiffening plate is connected in tensively strong manner on one side to the rotor shaft and on the other side to the middle zone, extending with a considerable radial component, of the second dish.

An even greater improvement is realized with an embodiment in which the shoring structure comprises:

a substantially truncated conical dish which is connected in tensively strong manner on one side to the rotor shaft and on the other side to the middle zone of the second dish, and extends from the inner zone of the first stiffening plate, and is connected rigidly with a bent peripheral edge to the inner surface of the middle zone of the second dish over substantially the whole surface of this peripheral edge.

Based on the same considerations as above given in respect of the peripheral edges of the rings, the device can advantageously further have the special feature that the attachment of the second stiffening plate and the peripheral edge of the truncated conical stiffening dish are mutually adjacent in the region of the middle zone of the second dish.

In the known rotation device according to NL-C-1009759 the manner in which the stiffening structures are coupled to the shaft is left unclear. In respect of the very great radial forces which occur, so tensile forces, it can be deemed essential that the tensile strength of the connection between the rotor shaft and the stiffening structure as well as the shoring structure meets very high mechanical standards of resistance to tensile strain, strength and non-deformability.

Is also important that the rotor is designed such that it can be produced in relatively simple manner, wherein the production tolerances are extremely low, so that it is even possible to dispense with a finishing process, in particular a balancing process.

In this respect the device can have the special feature that the first and/or the second stiffening plate and/or the truncated conical dish is clamped with a central zone between two clamping rings coupled to the rotor shaft.

Particularly favourable in respect of a very high mechanical strength and lack of deformability on the one hand and a low mass inertia and mass on the other is an embodiment in which the clamping rings have a radially outward narrowing form, in the manner of a Laval construction.

A Laval construction is a model of an optimal rotor developed on a theoretical basis, wherein the material of a more or less disc-like rotating structure is under roughly the same strain of tension at any radial position. Such a structure can be theoretically calculated and is found to have an increasing axial dimension in the region of the central axis, this dimension becoming smaller as the radial distance from the axis increases. Use can fruitfully be made of this insight in the invention in order to obtain a low mass inertia and a low mass.

Use can also be made of this insight in a further development, wherein the stiffening plate is clamped between the clamping rings via round discs which are situated on both sides of the stiffening plate and which have a greater diameter than the clamping jaws, in the manner of a Laval construction.

An extremely low dimensional tolerance and freedom from deformation can be guaranteed with an embodiment in which the first and/or the second stiffening plate are clamped via a truncated conical inner zone between two correspondingly formed annular clamping surfaces of the clamping rings.

In a specific embodiment hereof the device can have the special feature that the annular zone at the position of the transition between the flat part of a clamping surface and the truncated conical part of this clamping surface and having an angle between 90° and 180° is provided with an annular recess. Protruding clamped plate material can be received herein such that the clamping force of the mutually facing clamping surfaces is not concentrated in this protruding material, but is distributed as well as possible over the whole surface, whereby the pressure remains controllable and limited.

The first plates together form a structure which can be implemented in different ways.

The device can for instance have the special feature that one ring forms part of a first plate;

a further ring forms part of or is connected to a second plate; and the first and the at least one second plate are disposed together as package.

According to yet another aspect of the invention, in accordance with those discussed above, the device can have the special feature that the rings are formed, placed and connected to the peripheral edge of the second dish such that the centrifugal forces occurring during rotation of the rotor are not sufficient to elastically deform the curved peripheral edge of the second dish to any substantial extent.

A very practical production method can be realized with an embodiment in which the clamping rings are pressed with force toward each other by means of a screw connection coaxial to the rotation axis of the rotor.

This latter embodiment can for instance have the special feature that the screw connection comprises two co-acting conical screw threads.

Co-acting conical screw threads are per se known. Provided they are well designed, they have good properties and have the great advantage of having an inherent locating function, rapidly and without erroneous positioning, whereby the two screw threads can be coupled to each other with a simple turn. It is found in practice that an adequate coupling is realized when the screw threads are rotated for instance through an angle in the order of 180° relative to each other. As a consequence of the single rotation direction of the rotation device according to the invention the screw connection will tighten itself during operation of the device, while the screw connection can nevertheless easily be released, for instance for maintenance or repair, by exerting a rotation force directed counter to this rotation direction.

According to a specific aspect of the invention, the device has the special feature that each dish or each dish part, optionally together with the second stiffening plate, is manufactured by deep-drawing.

It is noted here that deep-drawing in one deep-drawing operation is not always possible. A deep-drawing process is limited by the geometry and the material properties of the starting sheet. In some circumstances multiple successive deep-drawing operations are required so that the final form is achieved in stages. It is possible to obviate this drawback to at least some extent by constructing a dish from more than one, for instance two or three, dish parts which can be attached to each other with annular zones, for instance by welding, in particular spot-welding. These dish parts can often be manufactured in one deep-drawing operation.

According to another aspect of the invention, the device can have the special feature that each dish or each dish part, optionally together with the second stiffening plate, is manufactured by successively performing the following steps of:

(a) providing a plate of metal with the form of a flat ring from which is missing a segment bounded by two complementary, for instance straight edges extending in radial direction;

(b) welding these two edges to each other such that a truncated cone of sheet metal is created, the half-apex angle of which is roughly equal to the angle of inclination of the dish or the dish part in the region around the half radius of the dish;

(c) providing a mould, of which the complementary mould parts to be urged with force toward each other each have a form roughly corresponding to the desired form of the dish or the dish part;

(d) placing the truncated cone in the opened mould;

(e) pressing the mould parts with force toward each other with elastic and plastic deformation of the truncated cone such that a dish or dish part, optionally together with a second stiffening plate, is obtained of the desired form;

(f) opening the mould; and (g) removing the obtained dish or the dish part, optionally together with the second stiffening plate.

The above described process can be referred to as "stretch-pressing".

As already discussed briefly above, in the above described two exemplary embodiments of the invention the device can have the special feature that each dish consists of two parts, i.e. a middle part and a peripheral part connected thereto via a circular join.

Further discussed is a variant in which the shoring structure has a second stiffening plate. Such a device can be combined with the device according to the previous paragraph, wherein the peripheral part is formed integrally with the second stiffening plate and the join is situated in the transition zone between the peripheral part and the second stiffening plate.

A device according to the invention can in general have the special feature that the dishes are formed from metal by deep-drawing, rolling, forcing, hydroforming, explosive deformation, by means of a rubber press, machining, casting, injection moulding, or a combination of at least two thereof.

In yet another embodiment the device has the special feature that the dishes are formed from plastic by injection moulding, thermoforming, thermovacuum-forming or the like, which plastic can optionally be reinforced with tensively strong fibres, or for instance glass fibres.

Finally, the invention can have the special feature that a dish is manufactured from sheet-metal which is laid in at least two layers one over the other in a mould with a mould cavity having a form corresponding to the desired form of the rotor, between which two layers medium under pressure is admitted to cause expanding of the sheet material during plastic deformation against the wall of said mould cavity for forming of the rotor.

The use of sheet material for manufacturing the dishes and the baffles has the advantage that the rotor can be very light. Sheet material can further be very light, smooth and dimensionally accurate. The choice of the material will be further determined by considerations of wear-resistance (depending on the passing medium), bending stiffness, mechanical strength and the like. For the rotor, the dishes of which have the described double-curved, general goblet shape, it is important that the main shape is retained even if the material is subjected to centrifugal forces as a result of high rotation speeds. Attention is drawn in this respect to the fact that the baffles arranged between the dishes and rigidly coupled thereto make a considerable contribution toward the stiffening of the rotor. It is also important for this reason to use a large number of baffles. A rotor can also be manufactured of very high dimensional accuracy and negligible intrinsic imbalance.

Small wall thicknesses make manufacture possible with deep-drawing.

It would also be possible to work on the basis of a machining process, for instance milling or spark machining. A rough form can also be realized beforehand with a suitable process, for instance by injection moulding of an aluminium, after which the final form is realized with a finishing process, for instance a machining process, such as milling, spark machining, grinding, polishing.

DETAILED DESCRIPTION OF THE PREFERRED EMBODIMENTS

Figure 1:
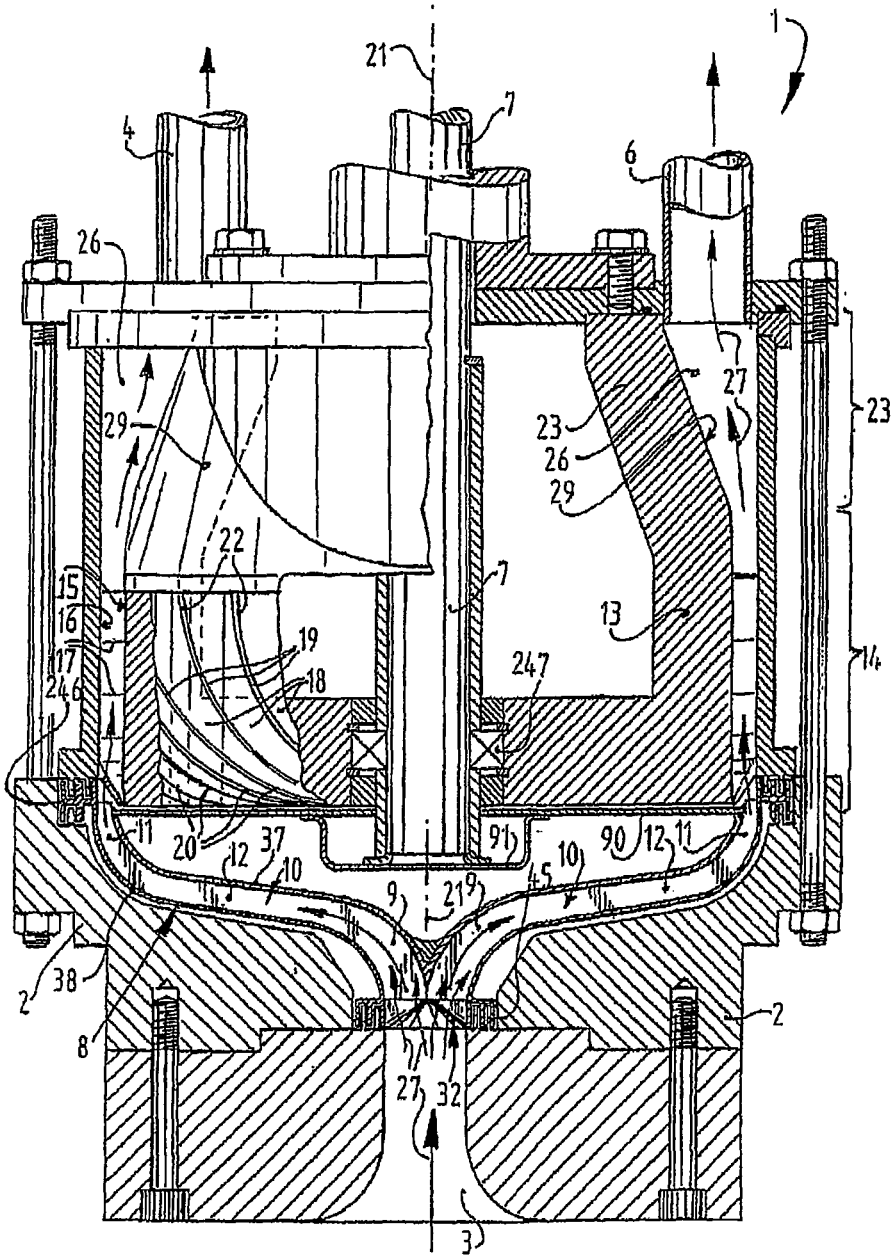
fig.1 Prior Art
FIG. 1 shows partially in cross-section, partially in cut-away side view a first exemplary embodiment of a rotation device according to NL-C-1009759, from the prior art.

FIG. 1 shows a rotation device 1. This comprises a housing 2 with a central axial first medium passage 3 and three axial second medium passages 4, 5, 6. Device 1 further comprises a shaft 7 which extends in said housing 2 and outside this housing 2 and which is rotatably mounted relative to housing 2, by means of among others a bearing 247, and supports a rotor 8, which will be specified below, accommodated in housing 2. Rotor 8 connects with a central third medium passage 9 to first medium passage 3. Third medium passage 9 branches into a number of angularly equidistant rotor channels 10, each extending in a respectively at least more or less radial main plane from third medium passage 9 to a respective fourth medium passage 11. The end zone of third medium passage 9 and the end zone of fourth medium passage 11 each extend in substantially axial direction. As shown in FIG. 1, each rotor channel 10 has a generally slight S-shape, roughly corresponding to a half-cosine function, and has a middle part 12 which extends in a direction having at least a considerable radial component. Each rotor channel has a cross- sectional surface area which increases from the third medium passage to the fourth medium passage.

Rotation device 1 further comprises a stator 13 accommodated in housing 2. This stator 13 comprises a first central body 14 and a second central body 23.

The first central body 14 has on its zone adjoining rotor 8 a cylindrical outer surface 15 which, together with a cylindrical inner surface 16 of housing 2, bounds a generally cylindrical medium passage space 17 with a radial dimension of a maximum of 0.2 times the radius of the cylindrical outer surface 15, in which medium passage space 17 are accommodated a number of angularly equidistant stator blades 19 which in pairs bound stator channels 18, and which stator blades 19 each have, on their end zone 20 directed toward rotor 8 and forming a fifth medium passage 24, a direction differing substantially, in particular at least 60°, from the axial direction 21, and on their other end zone 22 forming a sixth medium passage 25 a direction differing little, in particular a maximum of 15°, from the axial direction 21, which fifth medium passages 24 connect to the fourth medium passages 11 and which sixth medium passages 25 connect to the three second medium passages 4, 5, 6.

The second central body is embodied such that between the sixth medium passage 25 and the second medium passages 4, 5, 6 three manifold channels 26 extend tapering in the direction from the sixth medium passages 25 to the second medium passages 4, 5, 6. These manifold channels are also bounded by the outer surface 29 of the second central body 23 and the cylindrical inner surface 16 of housing 2.

FIG. 1 indicates with arrows a general medium throughflow path 27. This path 27 is defined between the first medium passage 3 and the second medium passages 4, 5, 6 through respectively: first medium passage 3, third medium passages 9, rotor channels 10, fourth medium passages 11, stator channels 18, sixth medium passages 25, manifold channels 26, second medium passages 4, 5, 6, with substantially smooth transitions between said parts. It is noted that in FIG. 1 the flow of the medium according to arrows 26 is shown in accordance with a pumping action of device 1, for which purpose the shaft 7 is driven rotatingly by motor means (not shown). If medium under pressure were to be admitted with force via medium passages 4, 5, 6 into the second medium passages 4, 5, 6, the medium flow would then be reversed and the rotor 8 would be driven rotatingly, also while driving shaft 7 rotatably, due to the structure of device 1 to be described hereinbelow.

The structure of the device is such that during operation there is a mutual force coupling between the rotation of rotor 8, and thus the rotation of the shaft, on the one hand and the speed and pressure in the medium flowing through said medium throughflow path 27.

The device can therefore generally operate as pump, in which case shaft 7 is driven and the medium is pumped as according to arrows 27, or as turbine/motor, in which case the medium flow is reversed and the medium provides the driving force.

Seals between rotor 8 and stator 13 are realized by means of labyrinth seals 145, 246.

Figure 2:
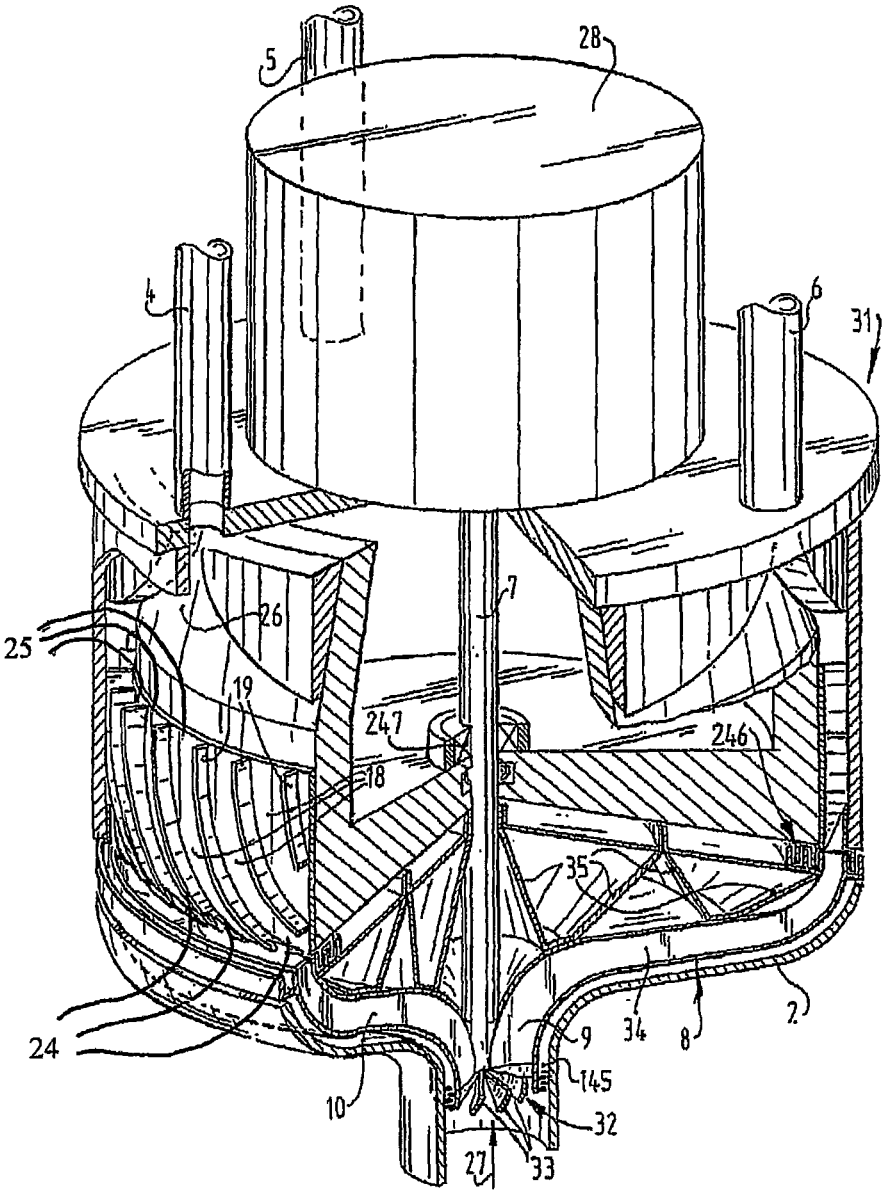
fig.2 Prior Art
FIG. 2 shows a partially cut-away perspective view of a second exemplary embodiment of a rotation device according to NL-C-1009759, from the prior art.

FIG. 2 shows a device 31 corresponding functionally to device 1. Device 31 comprises a drive motor 28.

As can be seen more clearly in FIG. 2 than in FIG. 1, an infeed propellor 32 with a number of propellor blades 33 is arranged in the third medium passage 9 serving as medium inlet.

Rotor 34 in device 31 according to FIG. 2 has a number of additional strengthening shores 35 which are absent in rotor 8.

Figure 3:
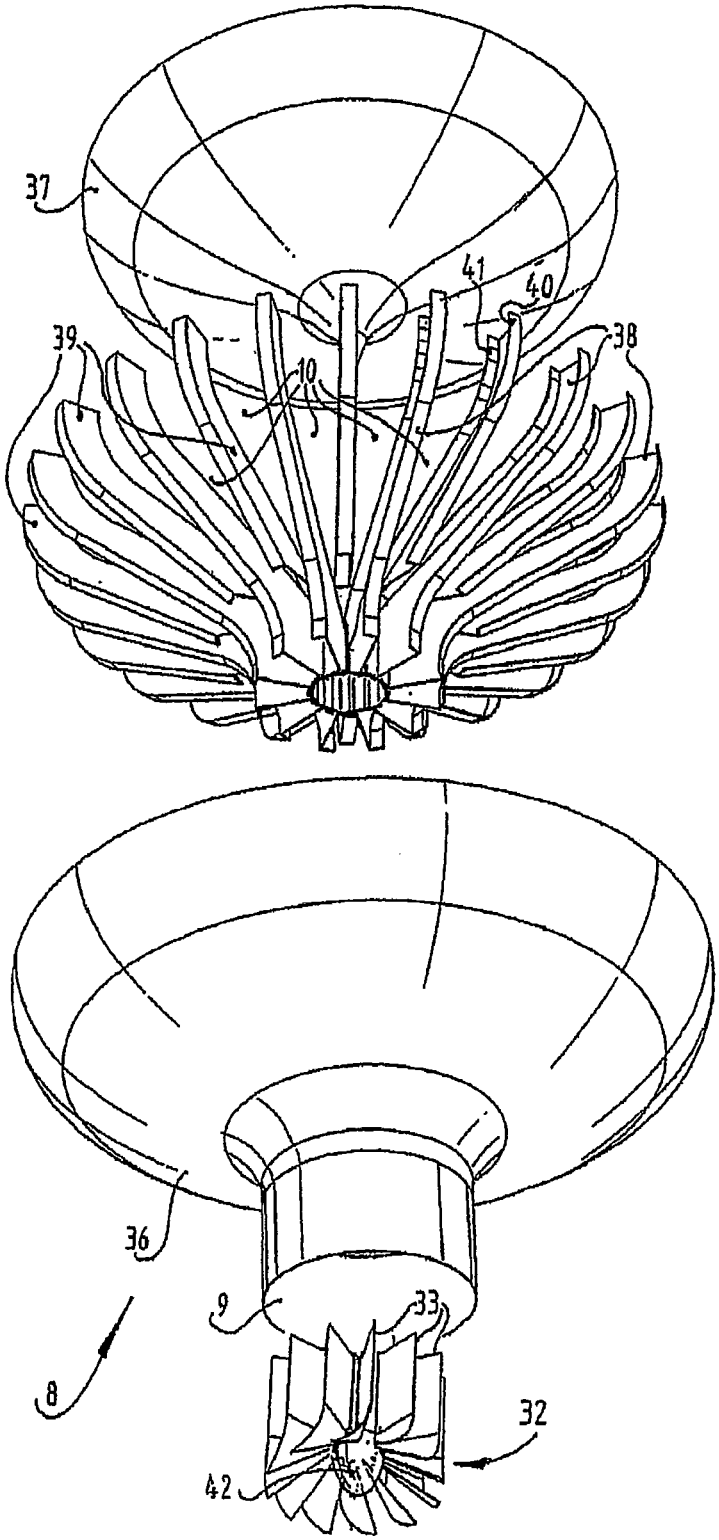
fig.3 Prior Art
FIG. 3 shows a perspective exploded view from the underside of a rotor according to NL-C-1009759, from the prior art.

As shown in FIG. 3, rotor 8 comprises a number of separate components which are mutually integrated in the manner to be described below. Rotor 8 comprises a lower dish 36, an upper dish 37, twelve relatively long baffles 38 and twelve relatively short baffles 39 placed interwoven therewith, which in the manner shown form equidistant boundaries of respective rotor channels 10. Baffles 38, 39 each have a curved form and edges 40, 41 bent at right angles for medium-tight coupling to dishes 36, 37. Baffles 38, 39 are preferably connected to the dishes by welding, in particular spot-welding, and thus form an integrated rotor. In the central third medium passage 9 is placed infeed propellor 32. This has twelve blades which connect to the long rotor baffles 38 without a rheologically appreciable transition. A downward tapering streamlining element 42 is placed in the middle of infeed propellor 32.

FIG. 2 shows the operation of the device 31 operating for instance as liquid pump. By driving shaft 7 with co-displacing of rotor 34 liquid is pressed into rotor channels 10 through the action of propellor 32. Partly as a result of the centrifugal acceleration which occurs, a strong pumping action is obtained which is comparable to that of centrifugal pumps. However, centrifugal pumps operate with fundamentally differently formed rotor channels. The liquid flowing out of rotor channels 10 displays a strong rotation and takes the form of an annular flow with a tangential or rotation-directional component as well as an axial directional component. Stator blades 19 remove the rotation component and guide the initially axially introduced flow once again in axial direction inside the manifold channels 26, where the part-flows are collected and supplied to respective medium outlets 4, 5, 6 which join together to form one conduit 43 so that the medium can be pumped further via one conduit. Other embodiments are also possible, wherein the outlet also extends almost exactly in axial direction.

Figure 4:
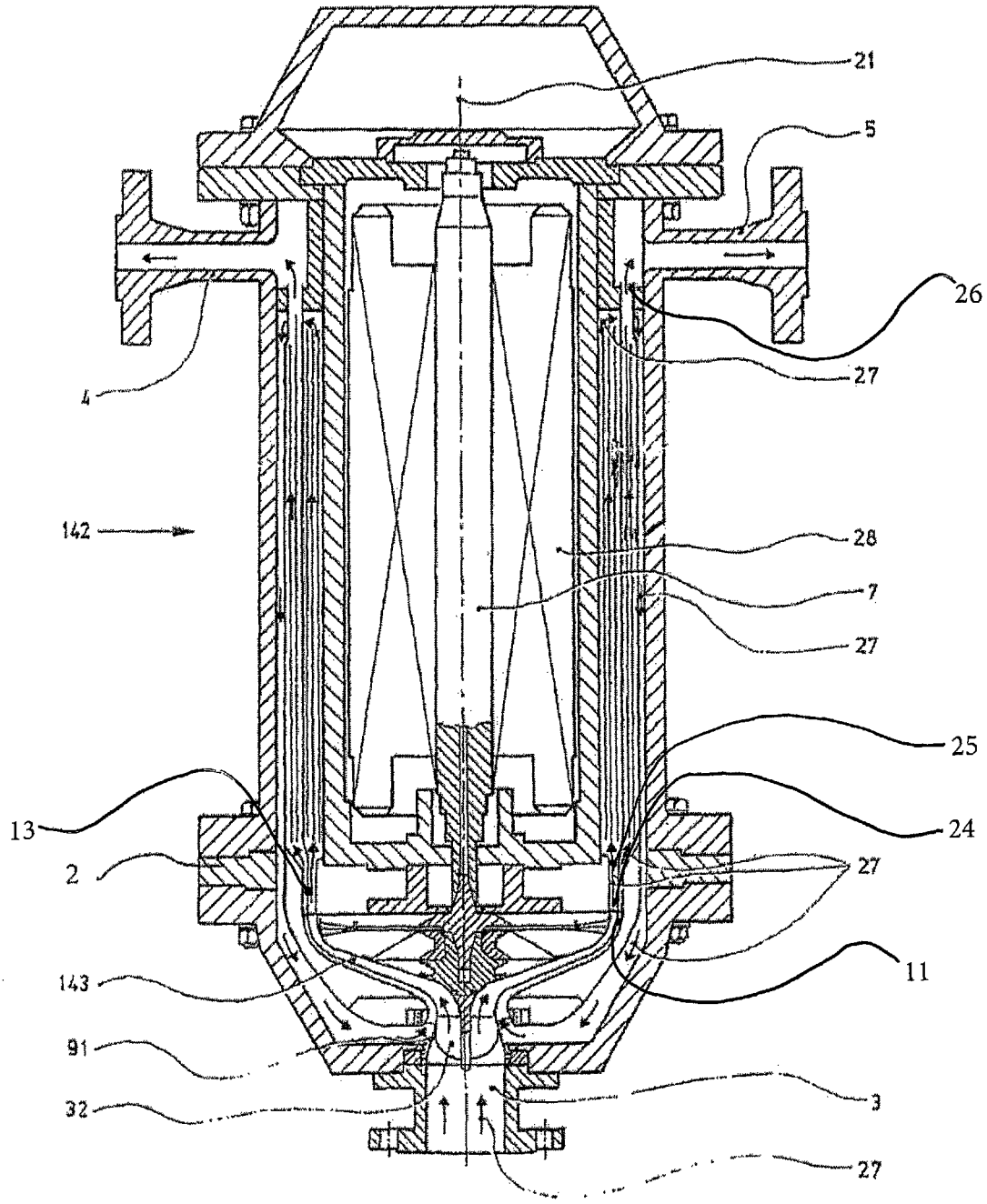
FIG. 4 is a longitudinal section of a rotation device according to the invention, wherein the structure is of a two-stage type, wherein two medium throughflow circuits are connected in cascade with each other, whereby for instance a pump can realize a substantially higher pressure increase.

FIG. 4 shows a rotation device 142 according to the invention.

In view of the description of the prior art already given as according to FIGS. 1, 2 and 3, the description of the essential aspects according to the invention will now suffice, in particular rotor 143.

It is noted that, other than in FIGS. 1, 2 and 3, device 142 is constructed such that both the rotor and the stator take a dual form, i.e. medium path 27 extends first through a first set of rotor channels, subsequently through a first roughly cylindrical space of the stator, then in return direction through a second cylindrical space of the stator, then again through the rotor, though now through a second set of rotor channels, subsequently through a third roughly cylindrical stator space and is then discharged through the second medium passage or medium passages. Owing to such a cascaded structure, which will be elucidated in more detail hereinbelow with reference to the following figures, a substantial pressure increase can be realized even in the case of gaseous pumped media.

A parallel cascaded structure, wherein the rotor comprises two or more pairs of goblet-shaped dishes placed in nested relation, has the advantage of a very high degree of compactness, a low weight and a high pressure resistance when compared to for instance a known centrifugal pump, which comprises a number of serial cascaded stages with multiple bearing-mounting of the shaft or shafts.

It is now already noted that the device according to the invention can comprise more cascade stages, for instance three or even four. The pressure increase coefficients per stage are multiplied by each other for the purpose of gases. In a theoretical case, in which the pressure increase per stage amounts for instance to a factor of 3 and this factor is the same for all three cascade stages, in the theoretical case with a threefold device according to the invention the pressure increase would amount to a factor of $3^3=27$. Such a pressure increase is conceivable and actually feasible in the case of pumped gases. Such a pressure increase cannot be realized for liquids owing to the wholly different thermodynamic properties thereof.

In the case of gases heavier than air, such as carbon dioxide, nitrogen and the like, a factor of 5 can for instance be realized. A pressure increase by a factor of 10-20 can even be realized for xenon. Such a pressure increase is important in the case of for instance carbon dioxide, which is very useful for cooling purposes but which for this purpose is preferably in a phase below the critical point at which the pressure amounts to a minimum of 64 bar.

Figure 5A:
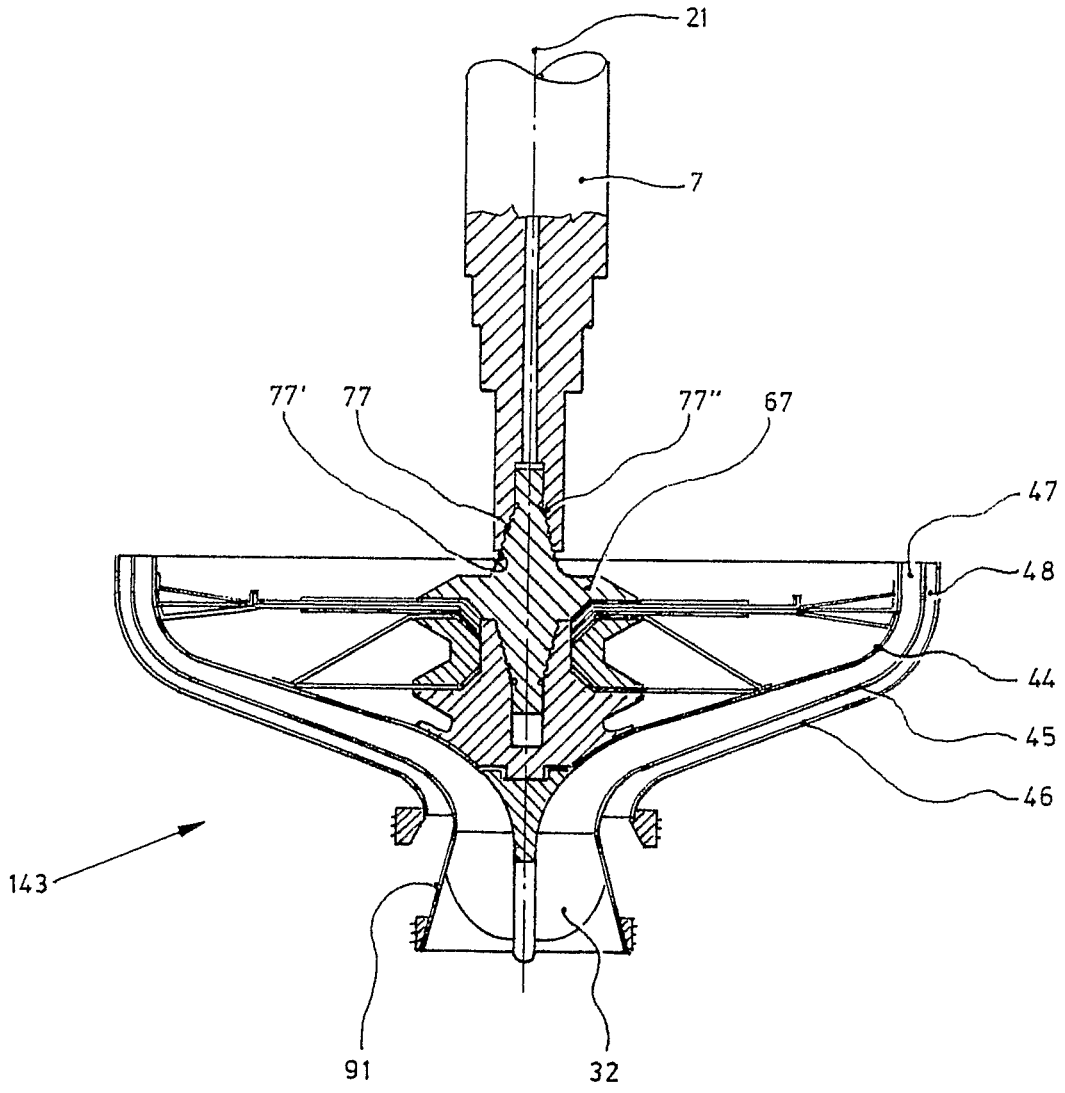
FIG. 5A shows the rotor of the device according to FIG. 4.
Figure 5B:
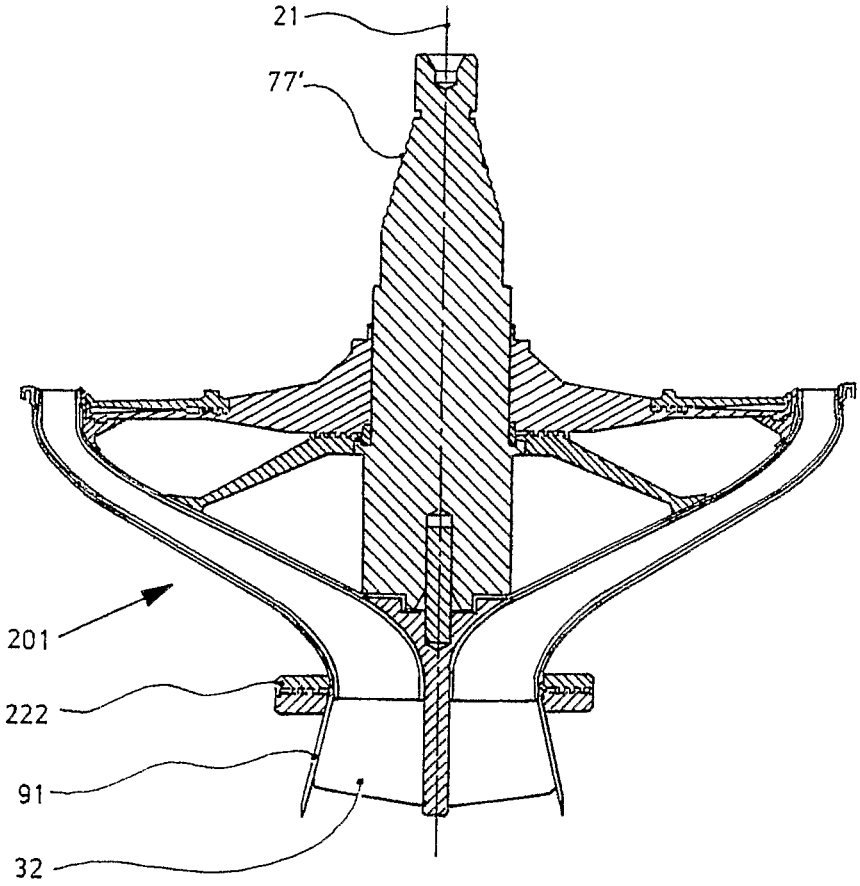
FIG. 5B shows a longitudinal section corresponding to FIG. 5A of another embodiment of the rotor.

FIG. 5A shows a longitudinal section through rotor 143 which is coupled to motor shaft 7 by means of a conical screw coupling 77.

Rotor 143 comprises three goblet-shaped dishes designated respectively 44, 45 and 46.

Figure 9A:
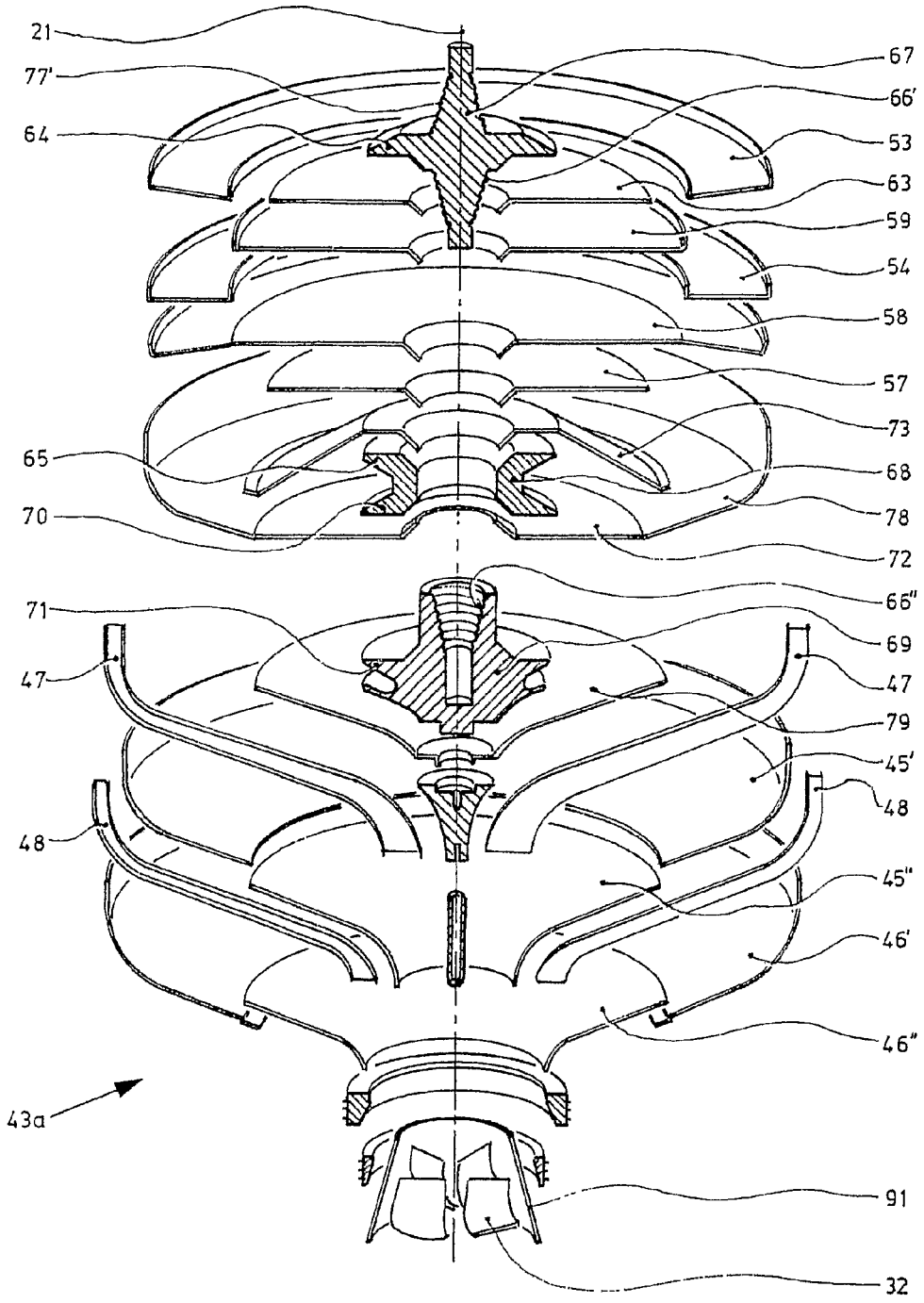
FIG. 9A shows an exploded view of the rotor according to FIG. 6A, wherein the components are drawn in longitudinal section and several components, in particular a number of rotor baffles, are omitted for the sake of clarity.
Figure 9B:
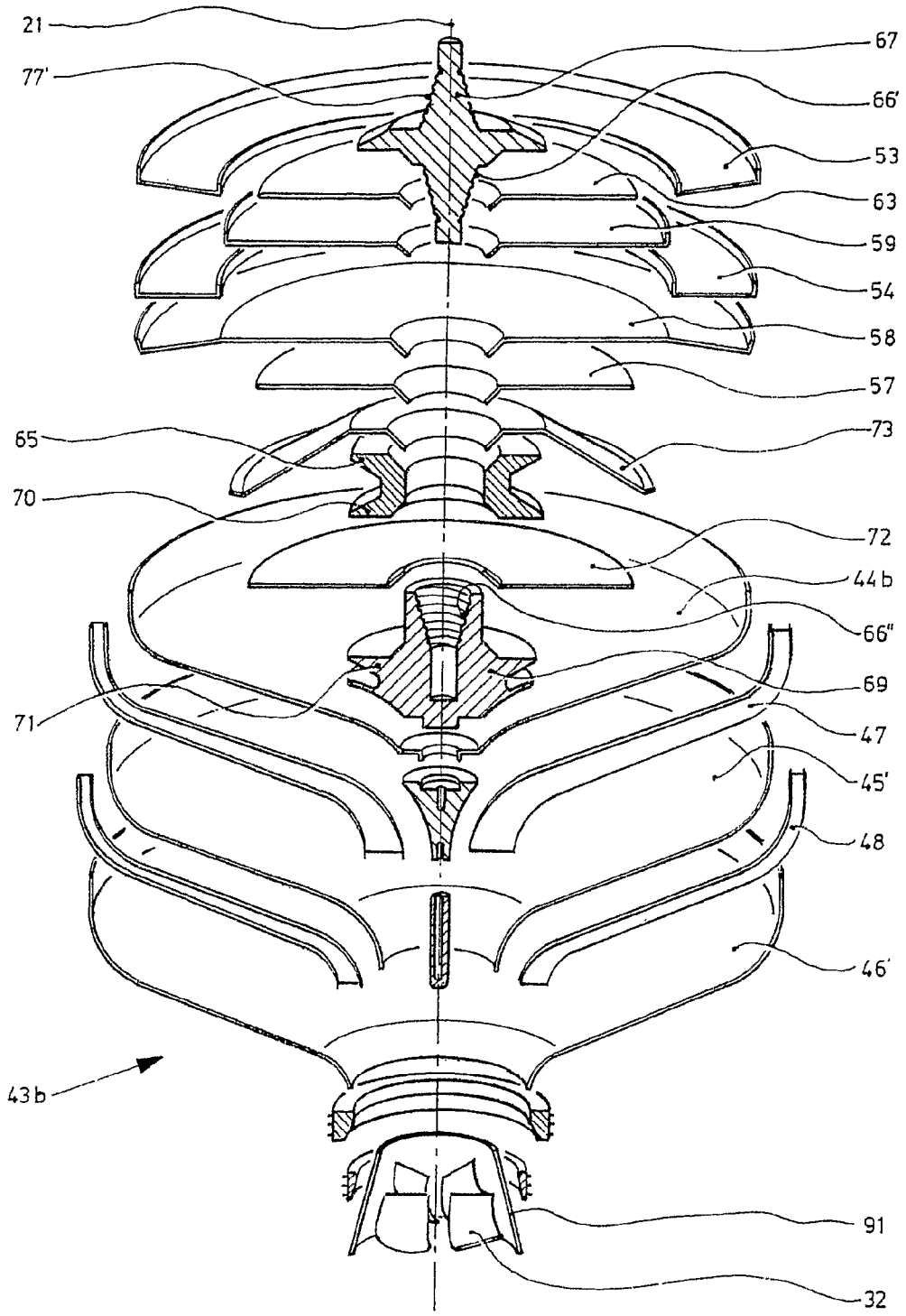
FIG. 9B shows an exploded view corresponding to FIG. 9A of the rotor according to FIG. 6B.
Figure 9C:
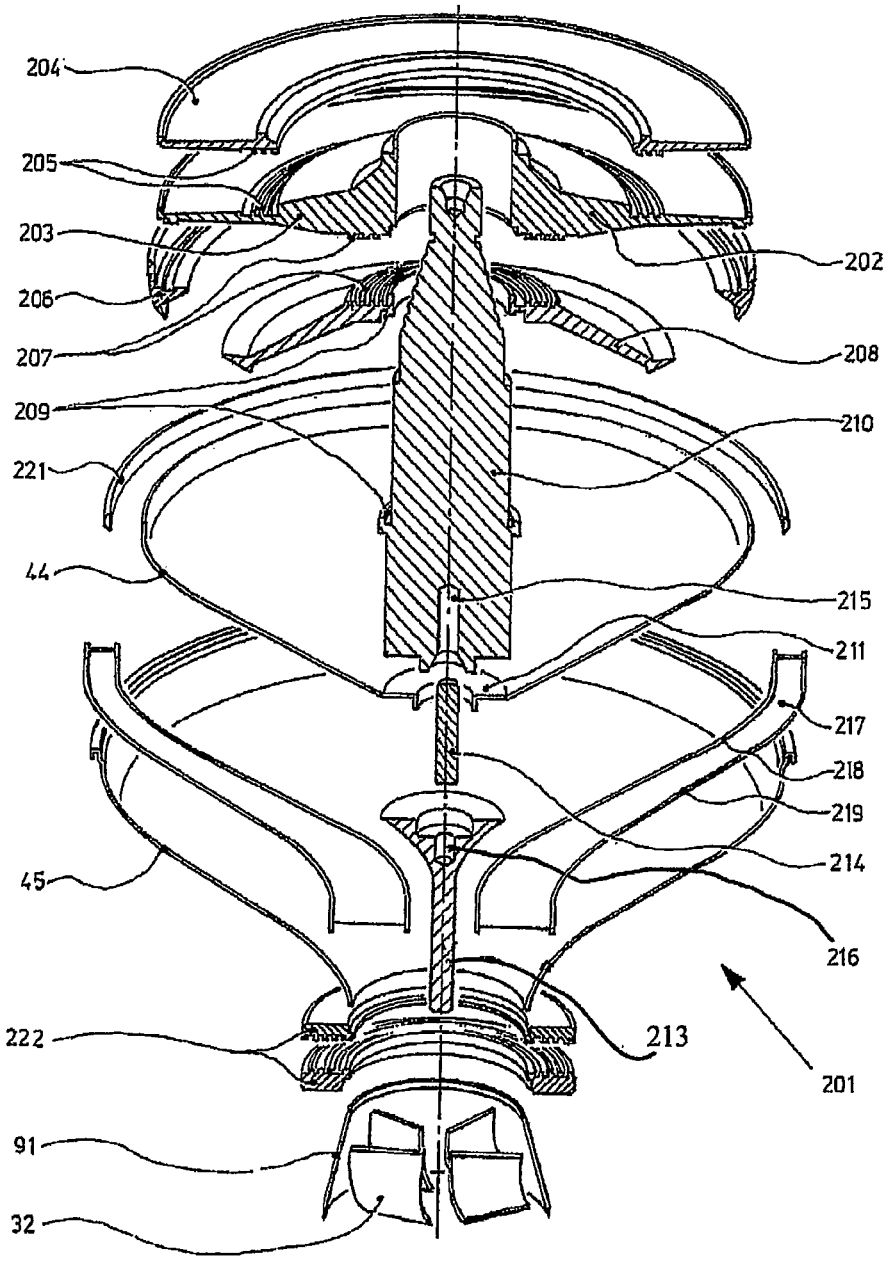
FIG. 9C shows an exploded view corresponding to FIGS. 9A and 9B of the rotor according to FIGS. 5B and 6C.

The innermost dish 44 is connected to the adjacent dish 45 by means of radial baffles 47 similar to baffles 38 and 39 according to FIG. 3. The outermost dish 46 is connected to dish 45 by means of baffles 48. Reference is also made to FIG. 9A and FIG. 9B in which (for the sake of clarity only two) baffles 47, 48 are shown. The reader must however picture the baffles being disposed in the manner of FIG. 3, so in angularly equidistant manner, such that two adjacent baffles, together with the adjoining dishes, bound the associated rotor channels.

FIG. 5A shows the manner in which only the inner dish 44 is stiffened in accordance with the teaching of the invention.

FIGS. 5B, 6B, 6C and 9C show a rotor 201. In accordance with the teaching of the present invention, inner dish 44 is substantially stiffened and strengthened by a first dish structure 202 extending in radial direction and consisting of a number of components of material with sufficient tensile strength, for instance a high-quality type of steel.

The form of dish structure 202 is chosen such that it complies with the above described principles according to Laval. The dish structure comprises a base dish 203 and a sub-dish 204 which is connected thereto and forms a fork therewith and which is connected to base dish 203 by means of a substantially flat spiral-shaped coupling of screw threads.

Base dish 203 and sub-dish 204 are connected to inner dish 78 via a peripheral ring 206.

A more or less truncated conical shoring dish 208 is connected to the inward facing part of base dish 203 via a second flat screw coupling 207 with co-acting spiral-shaped screw threads. It is rigidly connected directly to inner dish 44. Shoring dish 208 is connected to core 210 of the rotor via an annular hook connection 209.

The radially innermost zone 211 of the goblet-shaped dish 44 has a flat disc-like part to which a cylindrical part connects. This form is shown particularly clearly in FIG. 9C. The zone in question is clamped into the upper core part 212 and the lower core part 213 of core 210. These parts are centered exactly by means of a centering pin 214 which fits tightly into blind holes 215, 216 in respective core parts 212 and 213.

Sub-dish 204, base dish 203, peripheral ring 206 and shoring dish 208 are connected to the goblet-shaped dish 44 by welding, in particular spot-welding. After screw connection 205 has been effected, sub-dish 204 is welded fixedly at a number of points to the part of base dish 203 lying thereunder.

Figure 25B:
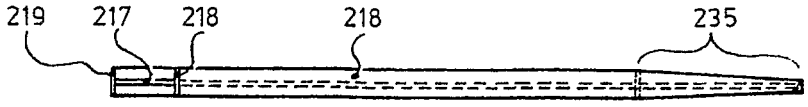
FIG. 25B is a top view of the blade of FIG. 25A.

The figures show a blade 217 with flanges 218, 219. Reference is also made in this respect to FIGS. 25A, 25B and 26.

It will be apparent that rotor 201 comprises a number of equidistantly disposed blades 217 as according to for instance FIG. 3.

As noted, flanges 218 are connected to inner dish 44. Use is made for this purpose of a spot-welding process.

Flanges 219 are welded in the same manner to outer dish 45.

Arranged between the end zone of flanges 219 and the outward bent peripheral end zone 220 of outer dish 45 is a tensively strong ring 221. This ensures a very high degree of resistance to elastic deformation of dish 45 at high rotation speeds. This ring 221 is also fixed in place on dish 45 and flanges 219 by spot-welding.

Inlet funnel 91 is connected to outer dish 46 by means of a third flat screw coupling 222.

Figure 6A:
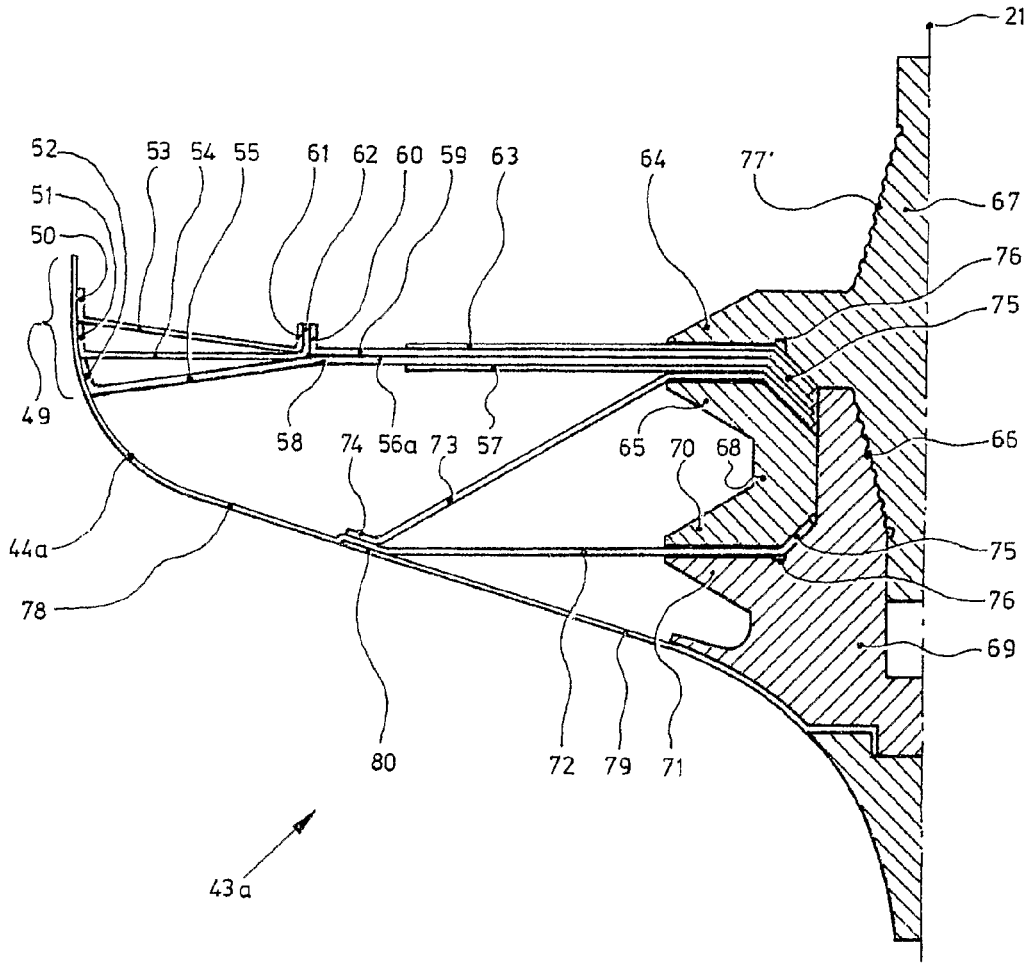
FIG. 6A shows on enlarged scale a part of a rotor according to figure FIG. 5 in a first embodiment.
Figure 6B:
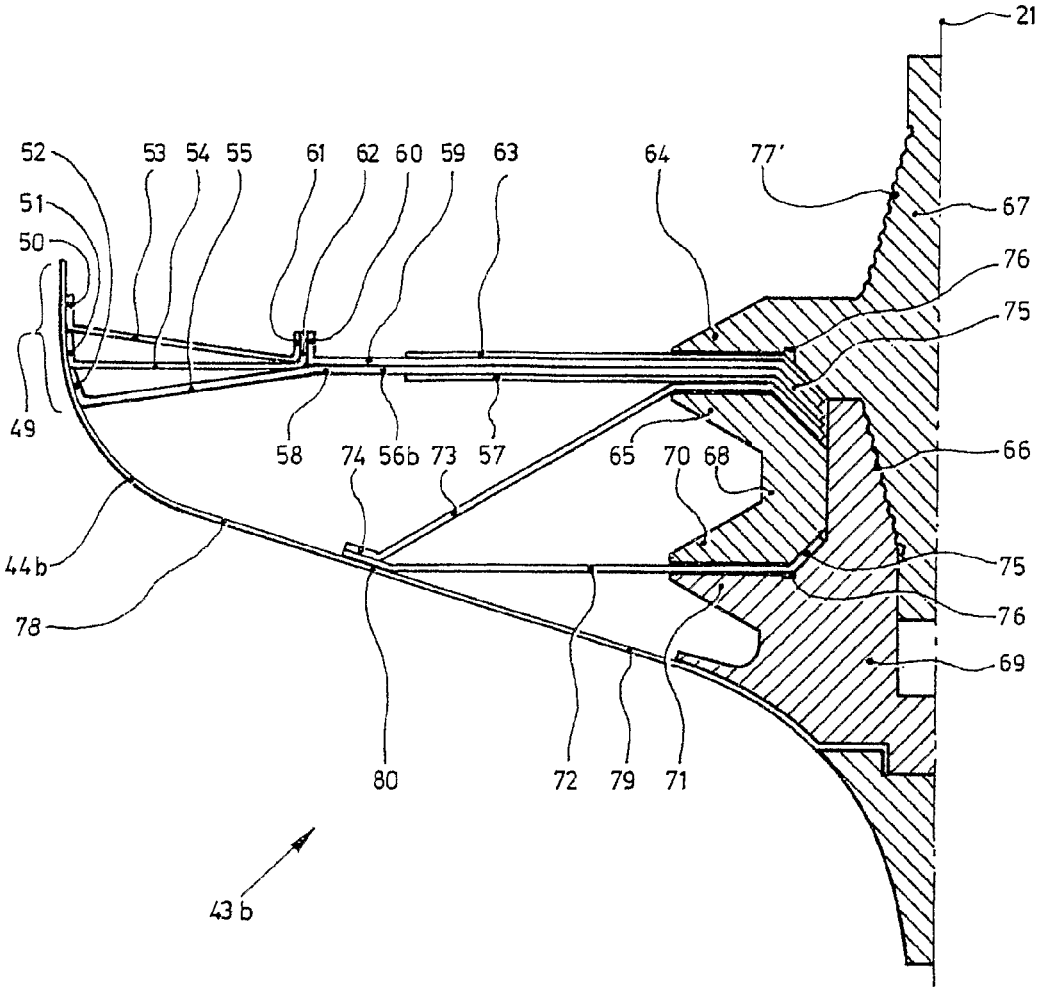
FIG. 6B shows a longitudinal section corresponding to FIG. 6A of a part of a rotor in a second embodiment.
Figure 6C:
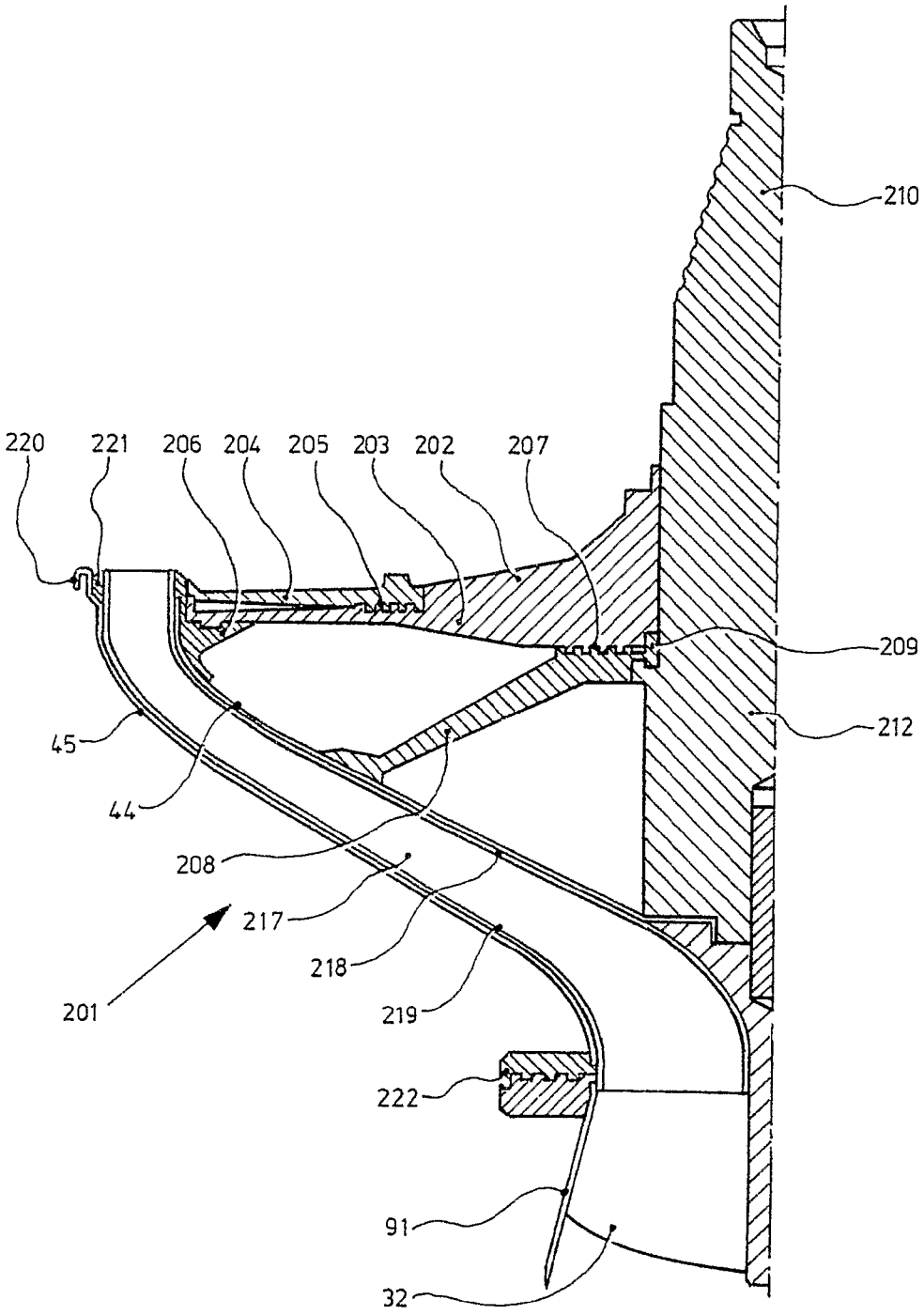
FIG. 6C shows a longitudinal section corresponding to FIG. 6B of a part of a rotor in a further embodiment as according to FIG. 5B.

FIGS. 6A and 6B show on larger scale two different embodiments of rotor 143, designated respectively 43*a* and 43*b*, in which the basic principles of the invention and further elaboration thereof are implemented in combination.

It is duly noted that, where possible and appropriate, at least functionally corresponding elements and components are always designated in the figures with the same reference numerals.

Peripheral edge 49 of dish 44 (44*a* and 44*b* respectively) is stiffened by the three bent peripheral edges 50, 51, 52 of respective rings 53, 54, 55, which form a peripheral zone of fork-like section of a first stiffening plate 56*a* in FIG. 6A, and first stiffening plate 56*b* in FIG. 6B.

Stiffening plate 56*a* comprises a relatively short lower disc 57, a disc 58 lying thereabove and also forming ring 55 and having a generally truncated conical form, a third disc 59 with a bent peripheral edge 60 which extends in substantially axial direction and to which the inner peripheral edges 61, 62 of rings 53, 54 respectively are connected.

As shown clearly in FIGS. 6A and 6B, ring 54 extends in line with third disc 59, therefore in radial direction.

Ring 53 has an angle of inclination in upward direction which approximately corresponds to the angle of inclination of ring 55 in downward direction, with the understanding that at the position of the transition zone between third disc 59 and rings 53, 54, 55 the first stiffening plate 56*a* in FIG. 6A, and first stiffening plate 56*b* in FIG. 6B is substantially only under strain of tension and not under strain of bending.

Peripheral edges 50, 51, 52 substantially connect to each other and have a form substantially corresponding to the local form of peripheral edge 49 of dish 44.

Situated above third disc 59 is an upper disc 63 with the same diameter as lower disc 57.

Discs 57, 56*a*, 59 and 63 of the package are mutually connected by welding, in particular spot-welding. Third Disc 59, ring 54 and ring 53 are mutually connected by spot-welding at the position of peripheral edges 60, 61, 62.

The whole package 57, 56*a*, 59, 63 has a thickness or axial dimension decreasing in steps as the radial distance increases. This is in accordance with a Laval construction.

In the construction of rotor 43 this principle is also applied at a further advanced level, i.e. the clamping between two clamping rings 64, 65 respectively, which are urged toward each other with force by means of a conical screw connection 66. As shown clearly in FIGS. 5 and 6, clamping rings 64 and 65 have an outward narrowing form in accordance with the theoretical Laval structure.

The form of core 67, of which the upper clamping ring forms part, likewise corresponds to the Laval principle, wherein the axial dimension of the material approaches axis 21 in asymptotic manner.

The lower clamping ring 65 forms part of a separate first ring 68 which is slidable over a second ring 69 which, together with a third clamping ring 70 of first ring 68 and a fourth clamping ring 71 forming part of first ring 68, exerts simultaneously with first clamping ring 64 and second clamping ring 65 a clamping force on a second stiffening plate 72 which extends in radial direction and which is connected in tensively strong manner to dish 44 in the region of a radius in the order of magnitude of 60% of the overall dish radius. The different possible ways of connecting the second stiffening plate 72 to dish 44*a*, 44*b* respectively will be further discussed with reference to discussion of the differences between rotor parts 43*a* and 43*b* according to FIGS. 6A and 6B respectively.

Situated at the position of first clamping ring 64 and second clamping ring 65 is a radial part of a substantially truncated conical dish 73 which is connected in tensively strong manner, on one side to core 67 and first ring 68 and on the other to the middle zone of dish 44. A bent peripheral edge 74 of dish 73 is connected by spot-welding to the inner surface of the middle zone of dish 44, substantially over the whole surface of this peripheral edge. Just as peripheral edges 50, 51, 52, peripheral edge 74 has an angle of inclination corresponding to the local angle of inclination of the dish.

The described sheet-form components are preferably manufactured from an aluminium (alloy), a titanium (alloy), stainless steel or spring steel. This makes production and assembly relatively easy and imparts superior mechanical qualities to the rotor.

The inner dish 44 stiffened by the stiffening structures according to the invention is connected rigidly by baffles 47, 48 to the further dishes 45, 46 such that the overall rotor structure is stiff.

All the stated plates and dishes 72, 73, 57, 56*a*, 56*b*, 59 and 63 are provided with internal peripheral edges, which are all designated 75 for the sake of convenience and which are clamped between correspondingly formed truncated conical surfaces of first clamping ring 64 and second clamping ring 65. Annular recesses 75, 76 are present at the corner points of these surfaces.

The preformed plates and dishes are thus connected in the manner clearly shown in FIGS. 6A and 6B to core 67 with a high dimensional stability, accuracy and tensile strength.

FIG. 5A shows that core 67 is connected to shaft 7 by means of a second conical screw connection 77.

The structural differences between rotor component 43*a* according to FIG. 6A and rotor component 43*b* according to FIG. 6B will now be discussed.

In the embodiment according to FIG. 6A the dish 44*a* consists of two parts, i.e. an outer dish part 78 which is formed integrally with second stiffening plate 72 and an inner dish part 79 which is connected smoothly thereto at the position of the transition between outer dish part 78 and second stiffening plate 72. A welded connection can provide a substantially seamless transition. This is important in respect of the desired rheological properties. The outer surface of dish 44*a* does after all form a boundary of the rotor channels.

Peripheral edge 74 of the truncated conical stiffening dish 73 also engages at the position of transition zone 80.

FIG. 6B shows a structure wherein dish 44*b* is formed integrally and second stiffening plate 72 is added later thereto as separate component by means of welding.

Dish part 78, with the stiffening plate 72 formed integrally therewith as according to FIG. 6A, has a form such it can be manufactured by deep-drawing from a flat sheet metal disc. The same applies for inner dish part 79.

This is not the case for dish 44*b* according to FIG. 6B. This dish has a form such that it cannot be manufactured by deep-drawing.

Deep-drawing has the drawback in all circumstances that the wall thickness of the formed component greatly depends on the local plastic deformation. The occurrence of both stretch and compression cannot be avoided in deep-drawing. As a result the final material properties can generally not be well controlled. An additional drawback is that owing to the relative inaccuracy of this process there is a high percentage of wastage during production of technically high-grade articles, products or components.

According to the invention use can therefore be made of another technique.

As shown in FIGS. 7A, 7B, 8A and 8B, dish 44*b* as well as each dish part 78, 72 and 79 respectively can be manufactured in another way. For this purpose the following steps as shown schematically in the figures are successively performed of:

(a) providing a plate 81 of metal with the form of a flat ring from which is missing a segment 84 bounded by two radial edges 82, 83;

(b) welding these two radial edges 82, 83 to each other such that a truncated cone 85 of sheet metal is created, the half-apex angle of which is roughly equal to the angle of inclination of dish 44 or the dish part in the middle region around the half radius of dish 44;

(c) providing a mould 86, of which the complementary mould parts 87, 88, 103 to be urged with force 89 toward each other each have a form roughly corresponding to the desired form of dish 101 or the dish part;

(d) placing truncated cone 85 in the opened mould 86;

(e) pressing mould parts 87, 88, 103 with force 89 toward each other with elastic and plastic deformation of truncated cone 85 such that a dish 101 or dish part 78, optionally together with a second stiffening plate 72, is obtained of the desired form;

(f) opening mould 86; and (g) removing the obtained dish 101 or dish part 78, optionally together with second stiffening plate 72.

Dish 101 has a bent peripheral edge 104 and two peripheral ribs, both designated with reference numeral 102. See also FIGS. 10, 11, 12 and 13.

It is noted that edges 82, 83 need not necessarily run radially but may also extend at another angle, and do not even necessarily have to be straight. One condition however is that it must be possible to form a truncated cone 85 on the basis of the blank 81 according to FIG. 7A, wherein edges 82, 83 connect to each other in the case where the cone has the desired form.

Figure 7A:
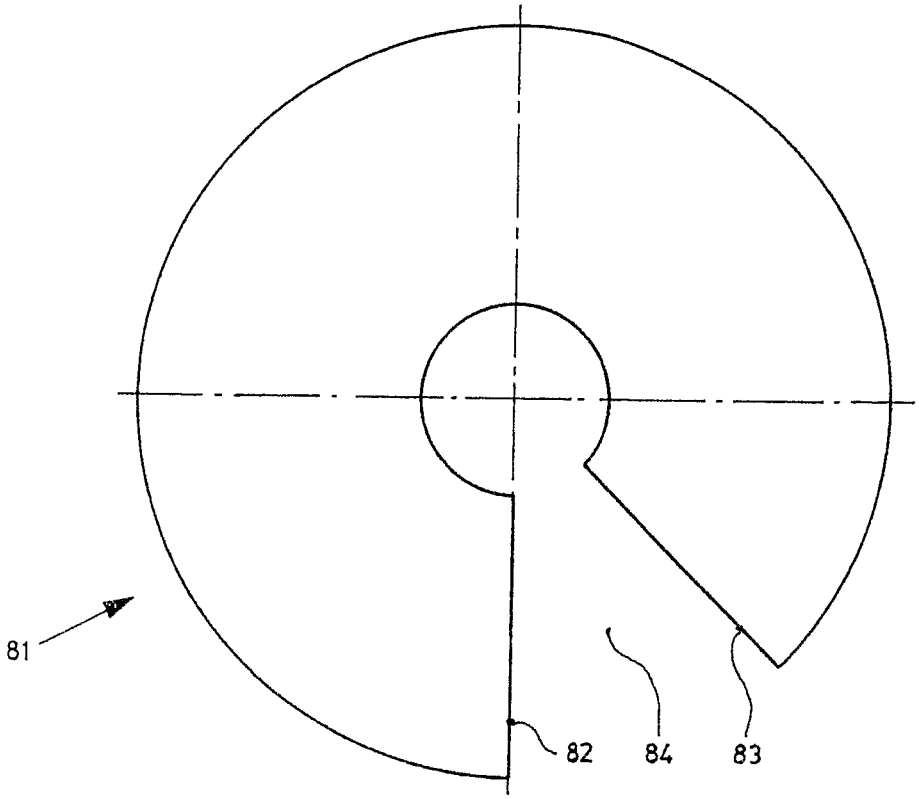
FIG. 7A shows a metal blank.
Figure 7B:
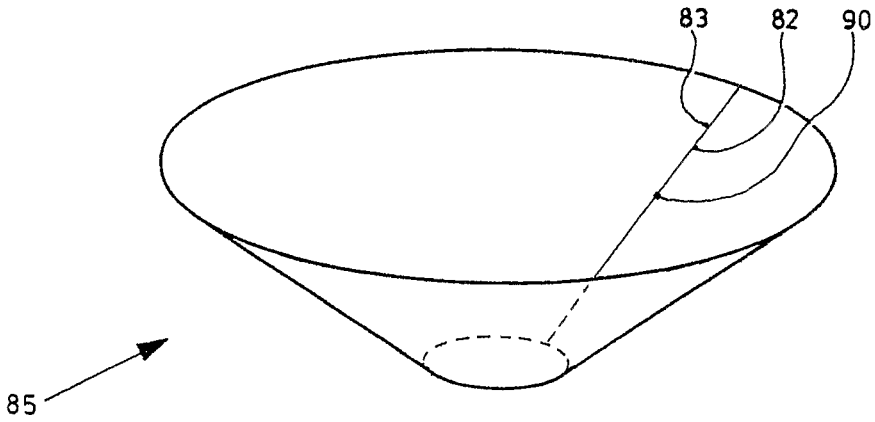
FIG. 7B shows a truncated cone form realized on the basis of the blank of FIG. 7A.
Figure 8A:
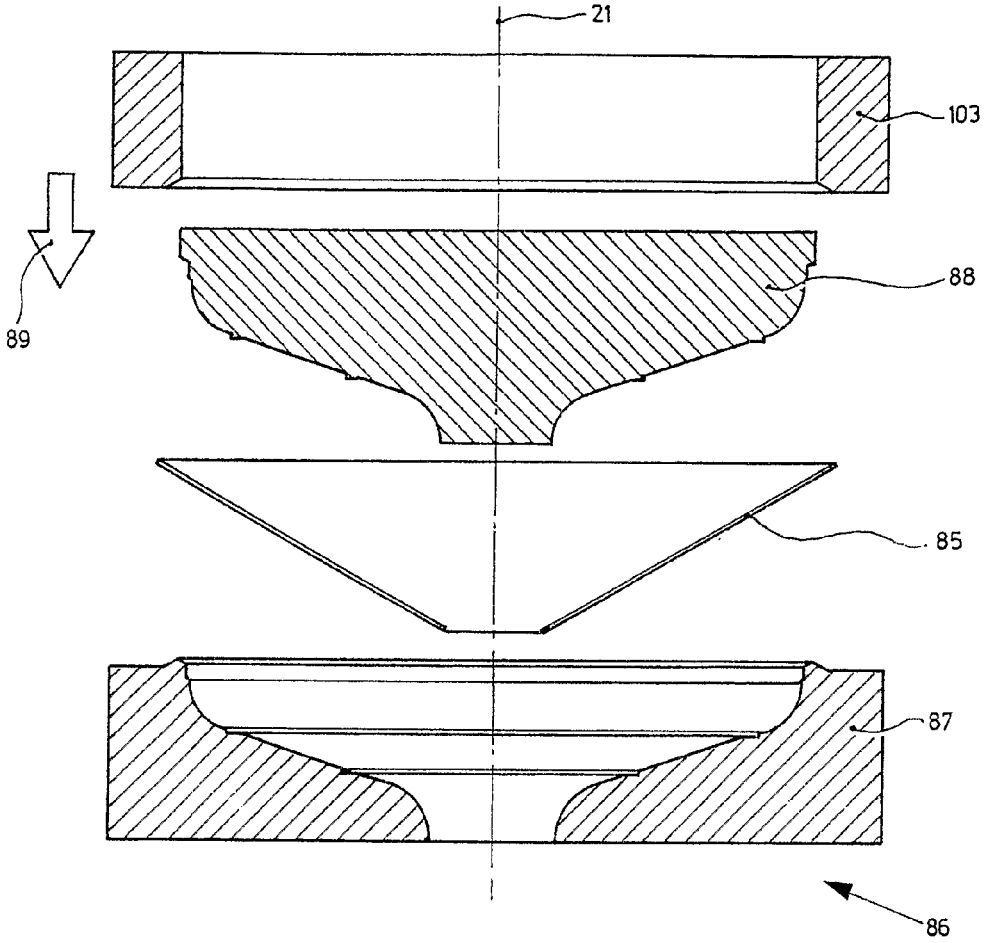
FIG. 8A shows a longitudinal section through a mould having the truncated cone of FIG. 7B therein for the purpose of forming a dish of a rotor according to the invention.
Figure 8B:
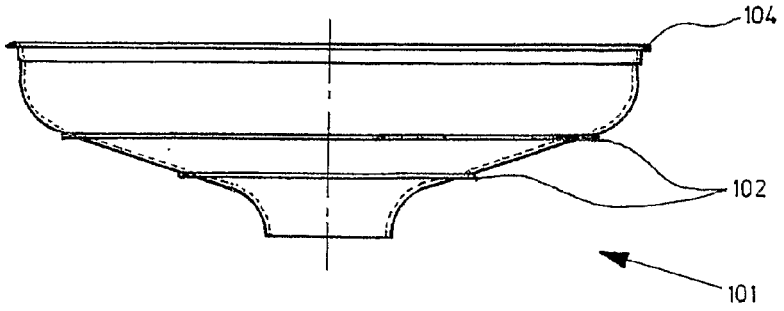
FIG. 8B shows a dish realized with the mould according to FIG. 8A.

In FIG. 7B the welded join along which the edges 82, 83 are welded to each other is designated with reference numeral 90.

FIGS. 9A and 9B refer to the rotor according to FIG. 5, be it in the two embodiments according to the rotor part of respectively FIGS. 6A and 6B.

FIG. 9A shows the manner in which the diverse components together form rotor part 43*a*. Assembly of the rotor from the drawn components can take place roughly in accordance with this exploded view, wherein the skilled person can select the appropriate sequence for this purpose on the basis of professional knowledge.

Shown is that the conical screw connection 66 consists of an outer thread 66' present on core 67 and a corresponding inner thread 66" present in core 67. In the same manner and referring to FIG. 5, there is present on the upper side of core 67 a tapering conical thread part with external screw thread 77' which co-acts with an internal screw thread 77" on the end of motor shaft 7.

Infeed propellor 32 is rotatably disposed in a more or less conically converging inlet funnel 91.

Infeed propellor 32 has six blades in the shown embodiment. The number of blades can however also be smaller or greater, and can particularly be in the range of 3 to 12.

Very effective operation is realized with an embodiment in which the infeed propellor or inducer 32 has double-curved blades.

In the embodiment according to FIG. 9A intermediate dish 45 is constructed from an outer dish part 45' and an inner dish part 45". These dish parts are mutually connected along a welded join.

Lower dish 46 is also assembled from two parts, i.e. an outer dish part 46' and an inner dish part 46". These dish parts are also mutually connected along a welded join.

Referring to, among others, FIGS. 6A and 6B, attention is drawn to the fact that rotor parts 43*a* and 43*b* derive their extreme mechanical stiffness for a significant part from a number of substructures, each having a generally triangular shape and producing the desired stiffness in the manner of shores.

Figure 10:
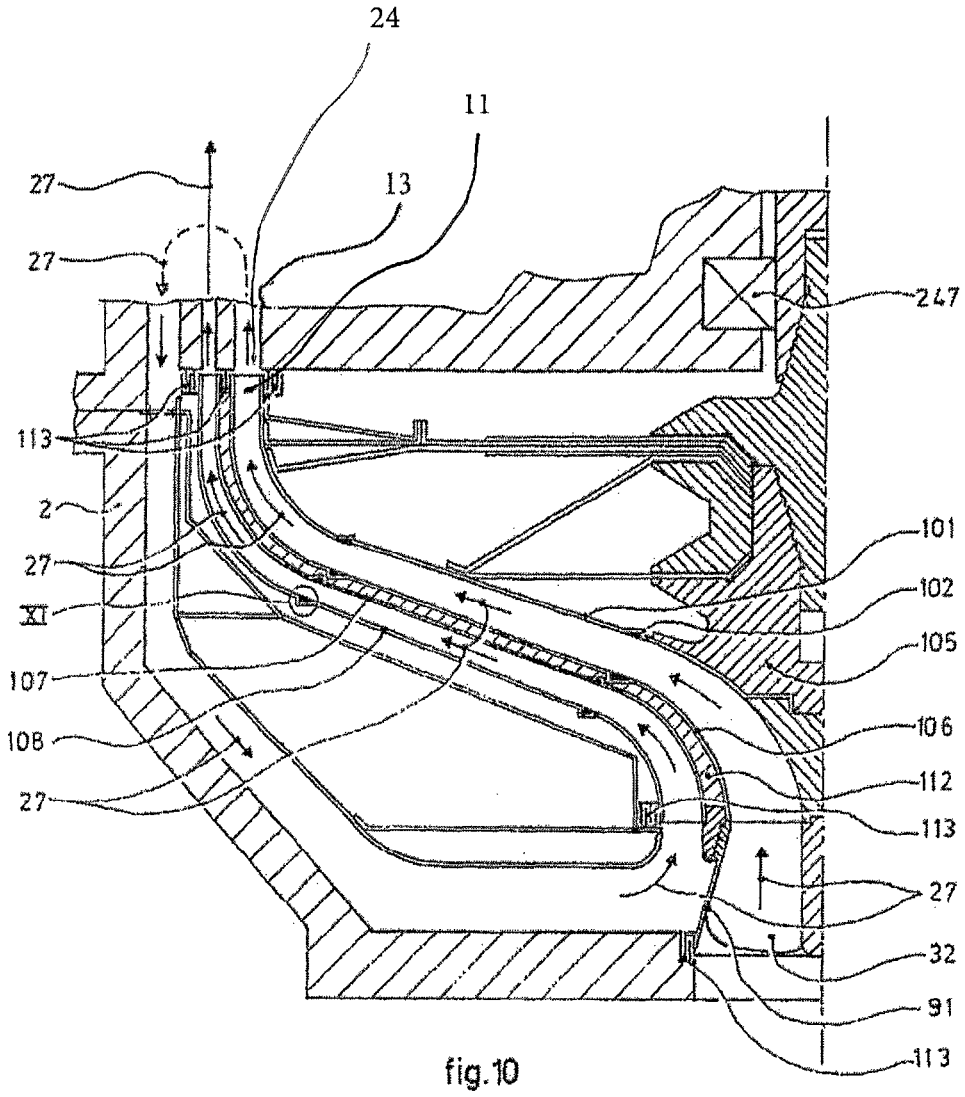
FIG. 10 shows a longitudinal half-section through a pump with a rotor according to the invention.

FIG. 10 shows a variant of rotation device 142 of FIG. 4, and in particular rotor 143 of FIG. 5.

Rotor 105 comprises four dishes modelled in goblet shape, i.e. an inner or first dish 101, a second dish 106, a third dish 107 and a fourth dish 108. Together with second dish 106, first dish 101 bounds the rotor channels in the first stage of the medium circuit indicated with flow arrows 27. Third dish 107 and fourth dish 108 bound the rotor channels of the second stage of medium path 27. In the present embodiment all dishes are provided with two encircling stiffening ribs 102, which have the form shown in FIG. 11, comprising a flat ring 109 and a cylindrical ring 110. All ribs 105 have roughly the same lengthwise sectional form. So as not to disrupt the flow pattern in medium path 27 the ribs are filled on the side of the rotor channels with an annular mass 111 which is finished so smoothly that it does not disturb the flow. Mass 111 consists for instance of a cured plastic or a ceramic cement.

The space between second dish 106 and third dish 107 is filled with a cured plastic mass 112. The described measures make an additional contribution toward the stiffness of rotor 105.

The rotor is rotatable in practically sealing manner relative to housing 2 and the components connected fixedly thereto. Use is made for this purpose of labyrinth seals, all designated with reference numeral 113. Alternative rotating seals will also be discussed hereinbelow.

Figure 11:
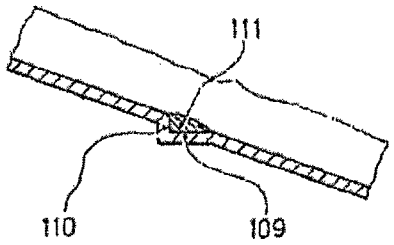
FIG. 11 shows on enlarged scale the detail XI of a dish of the rotor of FIG. 10.
Figure 12:
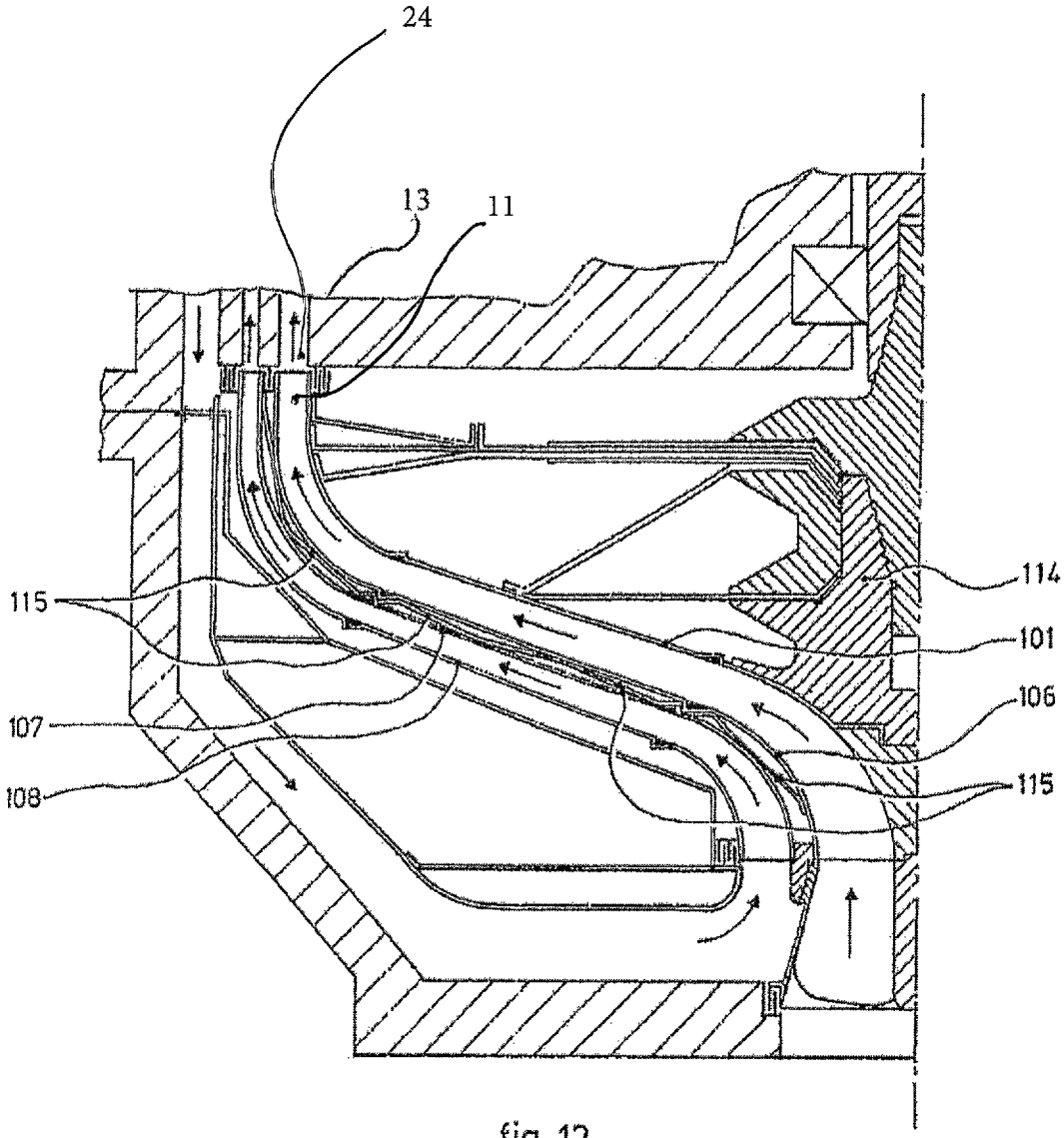
FIG. 12 shows a longitudinal section corresponding to FIG. 10 through a variant.

FIG. 12 shows an embodiment almost wholly corresponding to that of FIGS. 10 and 11, but wherein the filling mass 112 between second dish 106 and third dish 107 is replaced by a structure wherein more or less truncated conical rings 115 of plate material modelled by stretch-pressing are welded fixedly to said dishes 106, 107, for instance by spot-welding.

Figure 13:
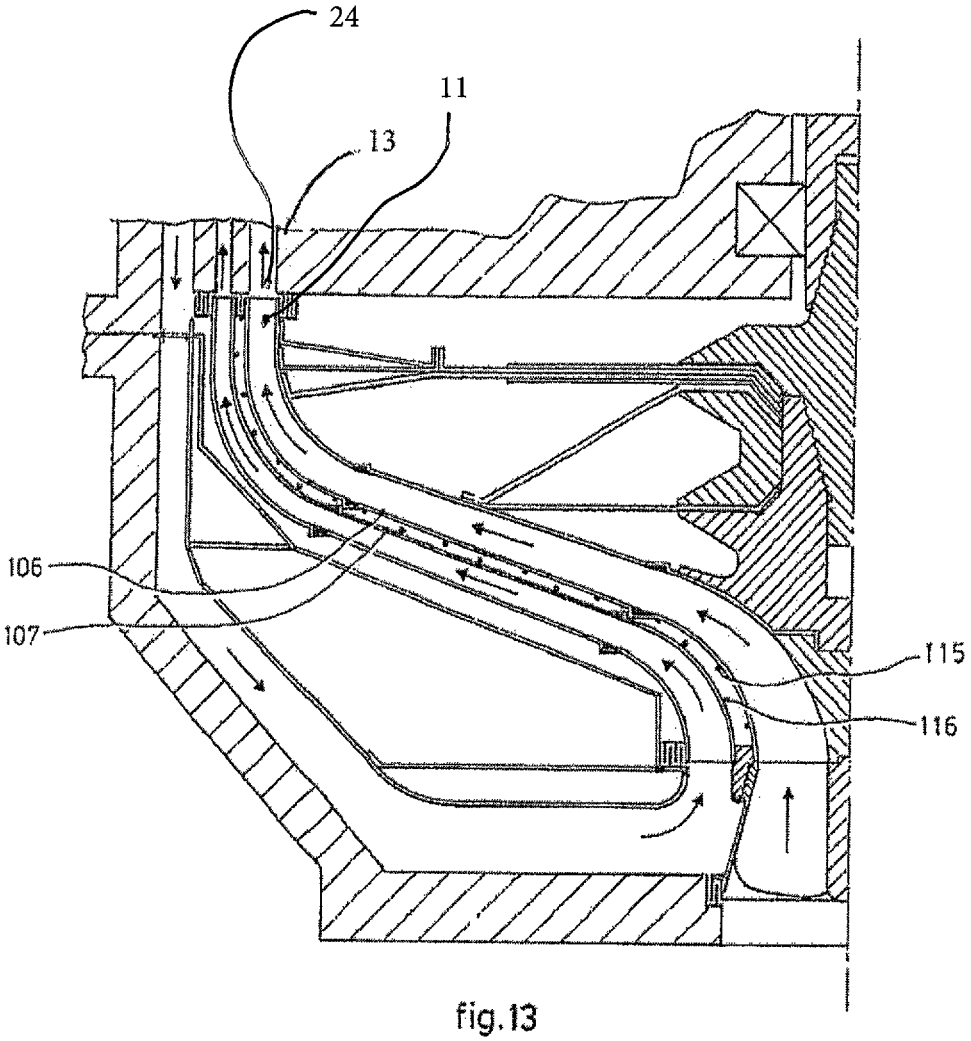
FIG. 13 shows a longitudinal section corresponding to FIGS. 10 and 12 through yet another embodiment.

FIG. 13 shows a variant wherein dishes 106 and 107 are stiffened by spirally wound threads 115, 116 respectively which are preformed in accordance with the form of the associated dish 106, 107 and are connected thereto by fusion welding.

Figure 14:
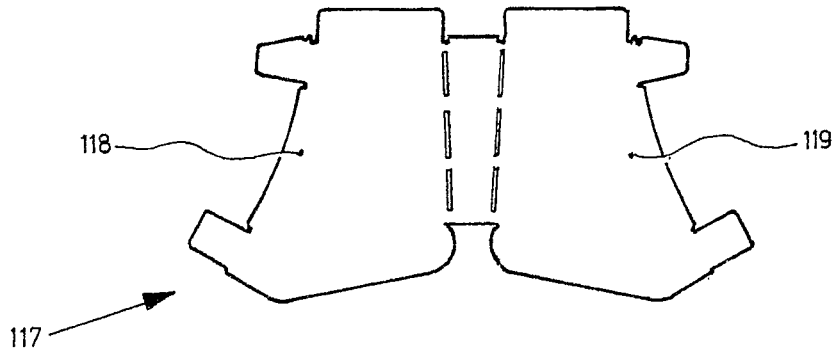
FIG. 14 shows a blank for manufacturing a combination of two inlet blades.
Figure 16:
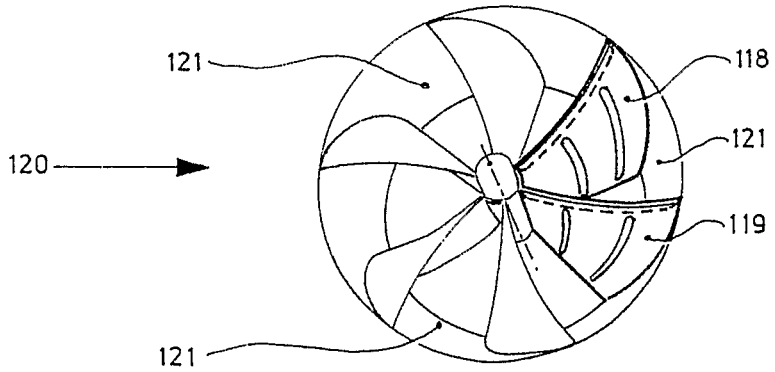
FIG. 16 is a perspective view at an angle from below of an infeed propellor comprising three pairs of blades as according to FIG. 15.

FIG. 14 shows a blank 117 for manufacturing by means of a pressing process a unit with two blades 118, 119 of an infeed propellor 120 as drawn in FIG. 16.

Figure 15:
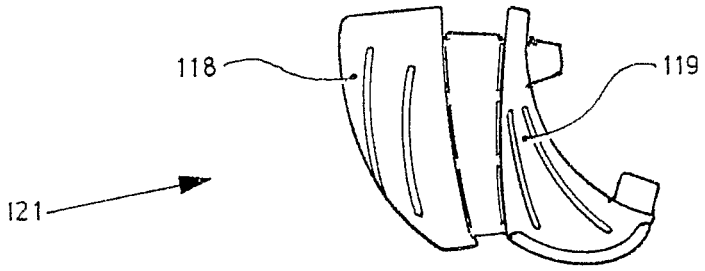
FIG. 15 is a perspective view of the unit of two blades after performing of a modelling process.

FIG. 15 shows a perspective view of the form of unit 121 resulting from modelling of blank 117 in correct manner in a mould.

FIG. 16 shows the manner in which three units 121 can be assembled to form an infeed propellor 120.

Figure 17:
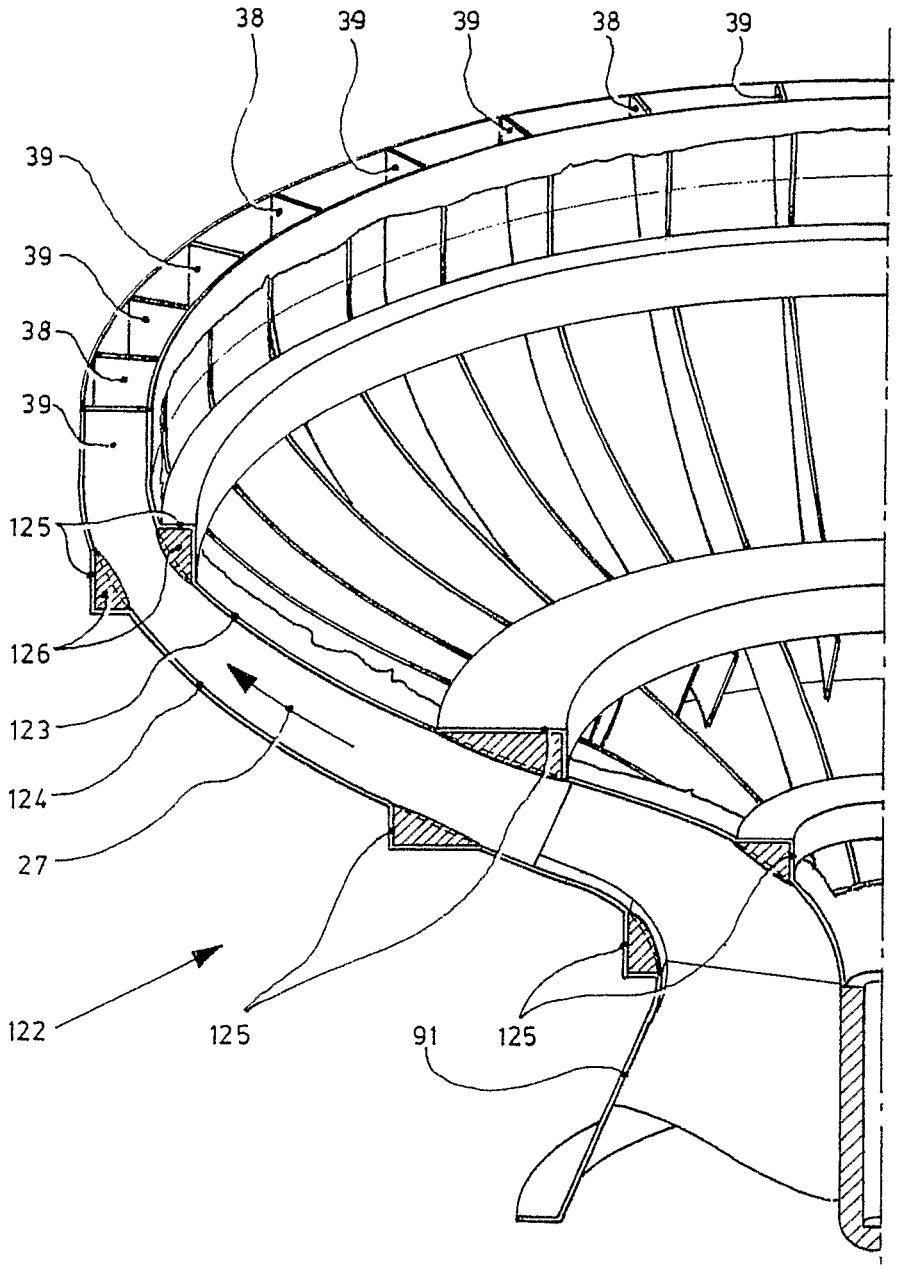
FIG. 17 is a cut-away partial view of a quarter of a rotor in yet another embodiment, wherein the greater part of the inner dish is not shown and the core is not shown, such that the placing of the baffles is clearly visible.

FIG. 17 shows a cut-away view of a quarter of a rotor 122, wherein the inner dish is partially omitted for the sake of clarity in the drawing.

Rotor 122 according to FIG. 17 is of the single type, i.e. intended as guide for only a single medium path 27, i.e. a non-cascaded embodiment.

Rotor 122 comprises an inner dish 123 and an outer dish 124, between which dishes the long baffles 38 and short baffles 39 are sealingly disposed.

Both dishes 123, 124 have three stiffening ribs, all designated with reference numeral 125. They are filled with a cured plastic mass or ceramic cement 126 which protrudes to some extent in the space bounded by dishes 123, 124. Indicated with broken lines is that baffles 38, 39 are partially accommodated in, and thus anchored by, these plastic masses 126. It is noted that masses 126 protrude only to a limited extent in medium path 27, and have a smooth, flowing form so that they have a negligible effect on the medium flow.

The structure of rotor 122 is such that ribs 125 make a considerable contribution toward the stiffness of dishes 123, 124.

Figure 18:
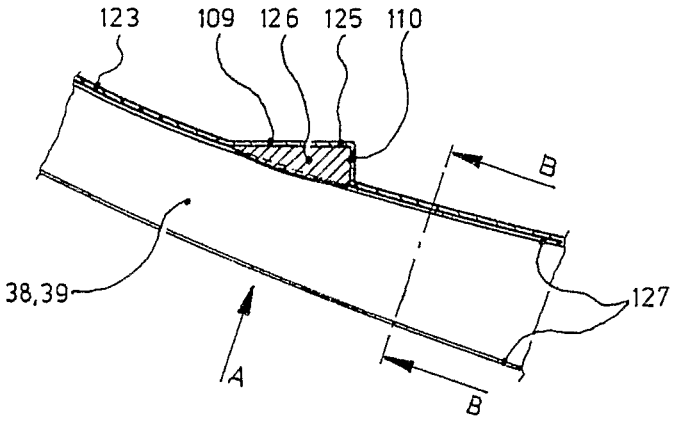
FIG. 18 shows a detail of a strengthening and mounting ring with groove at the position of the baffles.
Figure 18A:
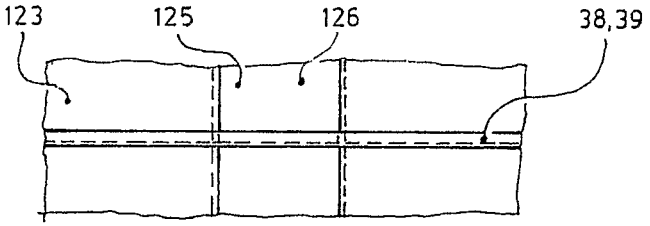
FIG. 18A shows the view A of FIG. 18, i.e. the blade in the ring.

FIG. 18 shows the described method of anchoring the baffles 38, 39. In contrast to the completely flat baffles 38, 39 according to FIG. 17, baffles 38, 39 according to FIGS. 18, 18A and 18B have bent edges 127 with which they are connected to the associated dish 123, 124, for instance by welding, spot-welding, glueing or soldering.

The filling mass is situated between the bent edges such that the medium channels bounded by dishes 123, 124 and baffles 38, 39 have a substantially rectangular cross-section and the baffles are positioned exactly within grooves cut into this filling mass 126.

FIGS. 19, 20, 21, 22 show partial end views of rotors, wherein baffles 38, 39 are formed in different ways and attached to dishes 123, 124.

Figure 18B:
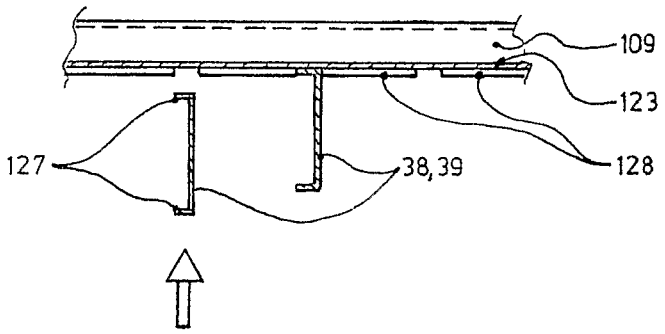
FIG. 18B shows the section B-B, i.e. the placing of the baffles in the recess of the ring.
Figure 19:
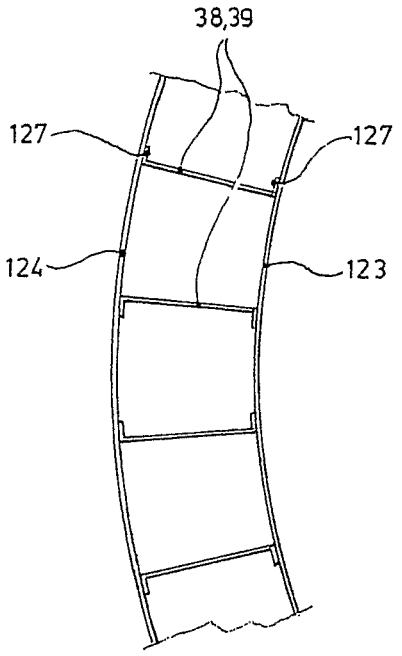
FIG. 19 shows a detail of the possible placing of baffles which, for the purpose of a good rotor balance, are placed in alternating orientation.

In the embodiment according to FIG. 19 baffles 38, 39 are provided as according to the embodiment of FIG. 18B with bent edges 127 with which they are coupled to dishes 123, 124, for instance by spot-welding. In the embodiment of FIG. 19, in contrast to the embodiment of FIG. 19B, they are placed in alternating orientation, i.e. pairs of corresponding edges 127 of adjacent baffles 38, 39 are directed toward each other.

Figure 20:
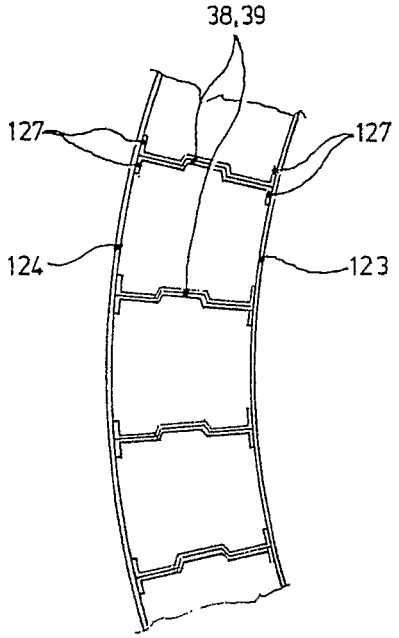
FIG. 20 shows a view corresponding to FIG. 19 of a variant wherein the baffles are placed back-to-back.

FIG. 20 shows an embodiment in which baffles 38, 39 consist of two sheet-metal strips whose whole surfaces lie against each other and which are profiled in the manner of a sheet pile and provided with bent edges 127 such that baffles 38, 39 are connected to each of the dishes 123, 124 by means of two bent edges 127.

Figure 21:
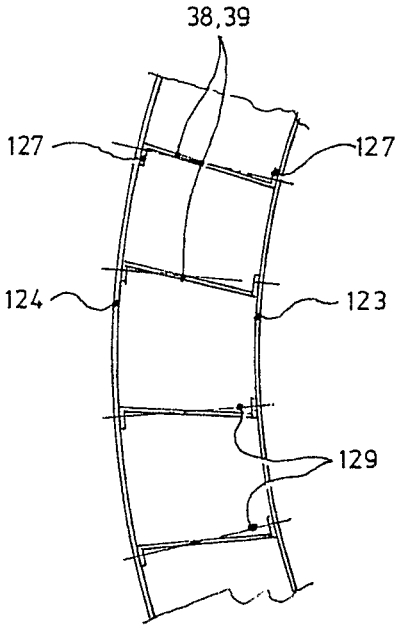
FIG. 21 shows a view corresponding to FIGS. 19 and 20 of an embodiment wherein the baffles have a slightly oblique position relative to the radial line.

FIG. 21 shows an embodiment in which baffles 38, 39 have a certain inclining position relative to the radial directions 129. Due to this arrangement the bent edges 127 are loaded at high rotation speeds in more uniform and balanced manner than for instance in the embodiment of FIGS. 18B and 19.

Figure 22:
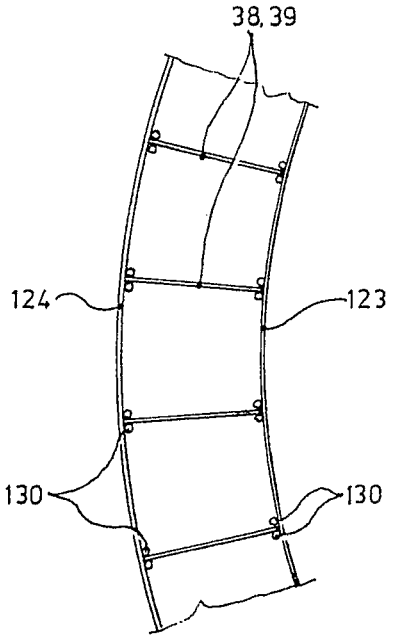
FIG. 22 shows a view corresponding to FIGS. 19, 20 and 21 of an embodiment in which the baffles are enclosed at their end zones and are welded fixedly between prearranged threads.

FIG. 22 shows an embodiment in which each of the baffles 38, 39 is enclosed between, and welded to, two threads prearranged on dishes 123, 124 and all designated with reference numeral 130.

Figure 23:
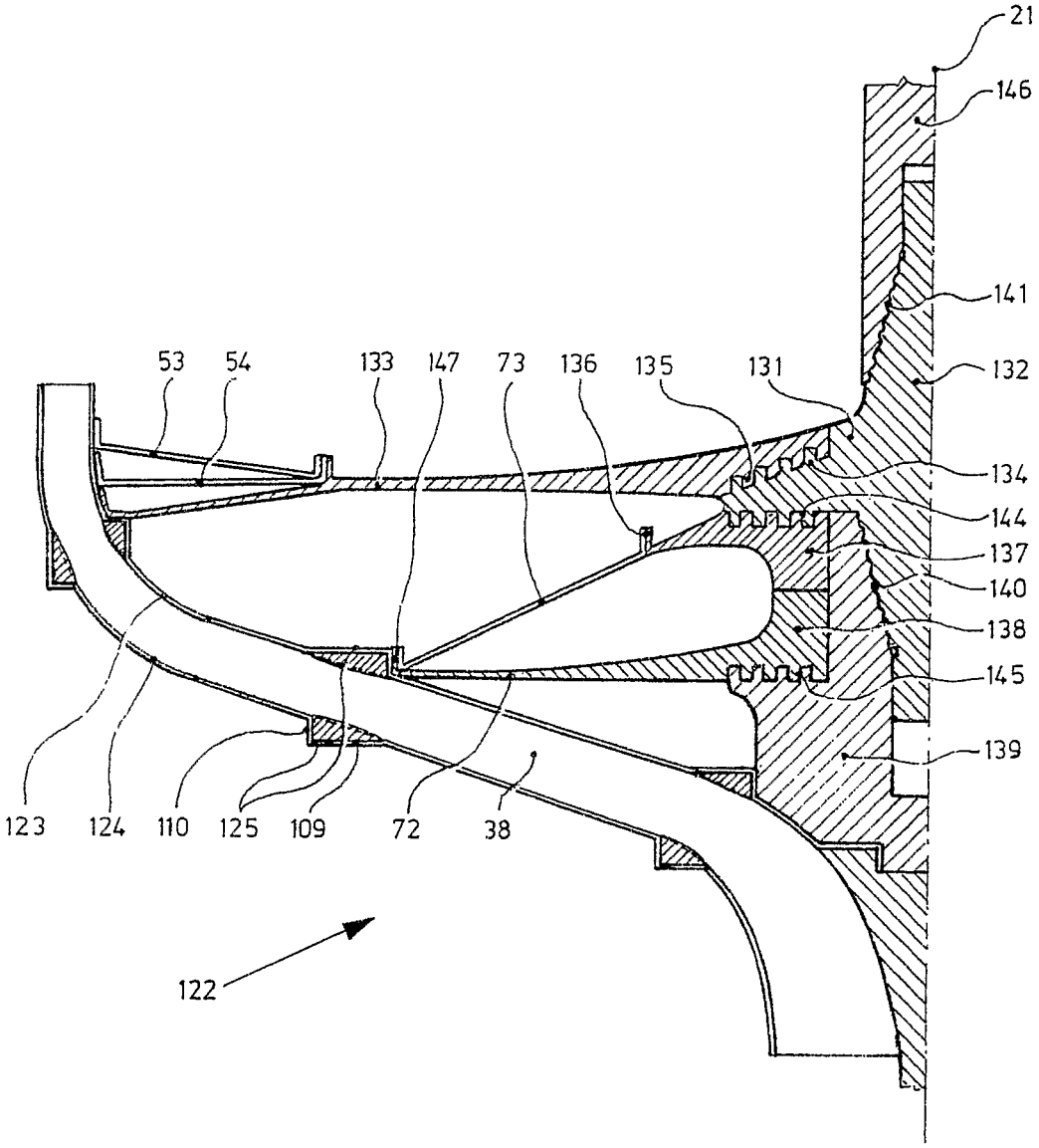
FIG. 23 shows a longitudinal section through a half-rotor with a structure corresponding to that of FIG. 17, but wherein the Laval stiffening construction is constructed in a different manner.

FIG. 23 shows more details of rotor 122.

Rotor 122 has a core 131 which is constructed in a manner other than core 67 according to FIGS. 6A and 6B.

Just as rotors 43*a* and 43*b*, the structure of rotor 122 has Laval-like forms, i.e. structures which are brought under strain of tension by centrifugal forces and have an outward narrowing form.

Inner core 132 is connected to a disc 133 by means of corresponding rotation-symmetrical toothings 134, 135 respectively. Inner core 132 and disc 133 can for instance be manufactured from a suitable metal and toothings 134 and 135 can for instance be arranged by rotary milling.

Preference is given to the use of the above described flat screw connection. Such a screw connection can be manufactured with a more than adequate precision. The screw coupling is effected by mutually engaging and subsequently rotating the relevant screw threads relative to each other through a certain angle. No form of fine balancing is necessary in practice. When mutually engaging concentric rings are used, a production milling machine must be able to operate with an exceptionally high precision. It is found in practice that fine balancing of the rotor is necessary when such a structure is used. This is the reason why preference is given to the use of the spiral-shaped, co-acting screw threads. These can be of a wholly flat type or also have a certain degree of conicity on the main surfaces.

Dish 73 is coupled via a welded connection 136 to a rotation-symmetrical first coupling part 137, while second stiffening plate 72 forms part of a second coupling part 138. These coupling parts 137, 138 are clamped against each other by means of connections 144, 145 with annular, mutually engaging toothings, and connected to inner core 132 and an outer core 139 which is connected to inner core 132 by means of a conical screw connection 140.

A drive shaft 146 is likewise coupled to inner core 132 with a conical screw connection 141.

Inner core 132, disc 133, first coupling part 137, second coupling part 138 and outer core 139 are manufactured from a suitable material, in particular the same metal as dishes 123, 124 and baffles 38, 39.

Rings 53, 54 are connected to the relevant inner dish 123 in the same manner as shown in FIGS. 6A and 6B.

Dish 73 is welded fixedly with its peripheral edge to inner dish 123 via a welded connection 147 with interposing of a bent peripheral edge of second stiffening plate 72.

Attention is drawn to the fact that disc 133 and second stiffening plate 72, as well as the outward protruding disc-like part of first coupling part 137, have a longitudinal cross-sectional form which complies with the theoretically ideal Laval form better than the structures according to FIGS. 6A and 6B.

Figure 24:
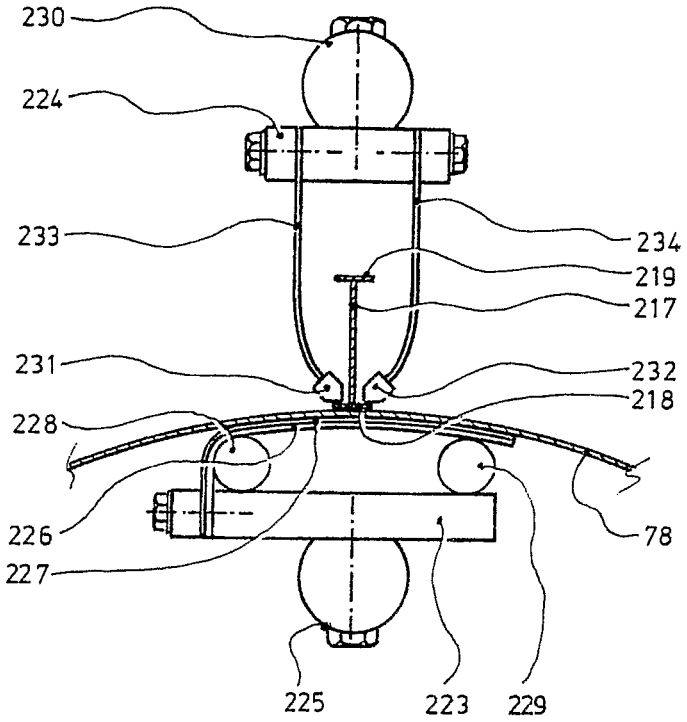
FIG. 24 is a schematic side view of a welding device for welding the blades of FiG. is 25A and 25B to the inner dish.

FIG. 24 shows a welding device for welding a blade 217 with flanges 218, 219 to dish 78. The welding device comprises a first electrode 223 and a second welding electrode 224. Via a connecting clamp 225 voltage is applied to a resilient plate 226, for instance of spring steel, which is covered on its side to be directed toward dish 78 with a plate 227 having good electrical conductivity, for instance of copper or silver. In the manner shown in FIG. 24 this flexible structure 226, 227 can adjust itself to the curved form of dish 78. For this purpose plate 226 can support with some force on support elements 228, 229.

Situated on the other side of dish 78 is the second welding electrode 224 with an electric connecting clamp 230. Spot-welding electrodes 231, 232 are carried by resilient strips with good electrical conductivity 233, 234, for instance of copper. These are both conductively connected to second connecting clamp 230. Owing to the resilient nature of strips 233, 234, when spot-welding electrodes 231, 232 are brought to the shown position they can pass slidingly over flange 219, then take up their drawn position, in which they press with some force on the protruding edges of flange 218, after which a welding current can be transmitted via connecting clamps 225, 230, whereby flange 218 is welded fixedly to dish 78. This process is repeated a number of times until the flange has been adequately welded with complete technical certainty. The process is then performed on a following blade until all blades have been welded in the stated manner.

Figure 25A:
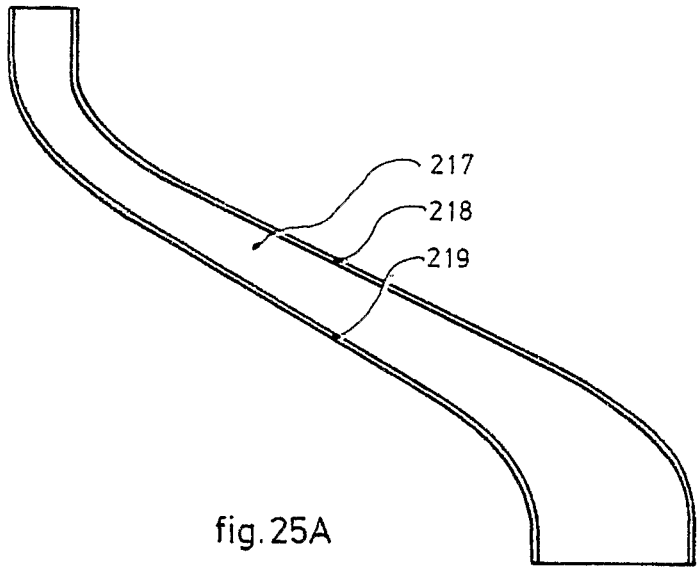
FIG. 25A is a side view of a blade in a further embodiment.
Figure 26:
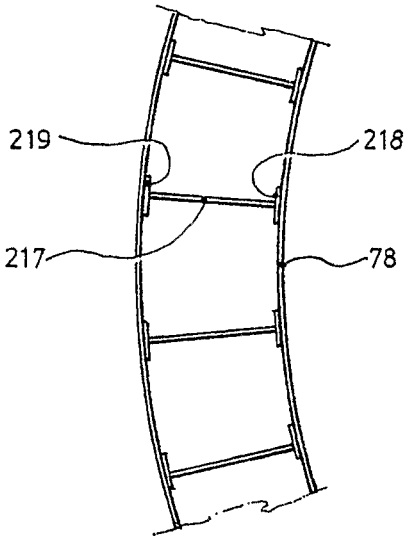
FIG. 26 shows a view corresponding to FIGS. 19, 20, 21 and 22 of a preferred embodiment of the blades after fixation between the dishes of the rotor according to figures FIGS. 25A and 25B.

FIG. 25A shows blade 217 with inner flange 218 and outer flange 219.

FIG. 25B shows that blade 217 with flanges 218, 219 has an inward tapering form on its radial inner zone 235. It will be apparent that this tapering form corresponds to the associated form of inner flange 218 as according to FIG. 25A.

Owing to this tapering form more space is available in the central area for accommodating flanges 218 than would be the case if inner flanges 218 had a uniform width.

It is duly noted that flanges 218, 219 are welded fixedly to blades 217. If desired, the material thicknesses of blades 217 and of flanges 218, 219 could differ from each other. This is not possible with the above described exemplary embodiments according to FIGS. 19, 20 and 21.

The rotation device according to the invention as discussed above can for instance be embodied as a pump driven by an electric motor, wherein the pump and the electric motor are assembled into a single unit. The rotation device according to the invention can also be embodied as a hydromotor or turbine which is for instance assembled with an electric generator for converting medium flow energy into electrical energy supplied by the generator.

The use of labyrinth seals is referred to in the above specification. Labyrinth seals are practical and reasonably inexpensive to produce, but have the drawback of not sealing to sufficient extent under all conditions. It is thus possible for instance for the liquid flowing through a rotor and stator to enter a motor or electric generator due to leakage, which may be undesirable. In such a case use could for instance be made of single or multiple mechanical seals, which can for instance be embodied as complementarily modelled sealing rings of for instance ceramic material pressing against each other and sliding sealingly over each other. It will be apparent that, as a result of friction, such seals will undergo a temperature increase and must therefore be cooled. This drawback is compensated by the fact that such a rotating seal can seal hermetically.

Another alternative seal is a so-called brush seal, comprising a ring of relatively hard bristles generally consisting of metal and having a usually rounded free top. The ends of these bristles are in sliding contact with a very hard and wear-resistant opposite layer of for instance silicon nitride or silicon carbide, or other appropriate, very hard material. Although the sealing of such brush seals is not fully hermetic, as in the described case of for instance ceramic discs pressed against each other, a brush seal nevertheless displays leakage which is about four times less than a corresponding labyrinth seal. The advantage of a brush seal is further that the dimensioning tolerance of the components sealing against each other is considerably greater than in the case of labyrinth seals, which only allow a very small dimensioning tolerance. It is noted that in a brush seal the sealing bristles are oriented trailing at an angle of about 45° relative to the local direction of displacement, so the relative direction of rotation.

Further discussed in the specification is the possibility of using conical screw couplings. Such conical screw couplings are highly practical in the context of the present invention because they enable a "blind" fitting, wherein the two screw components are mutually self-locating. The use of one or more conical screw couplings thus enables a high measure of compactness and integration of an electric motor and a rotor, or a rotor and an electric generator.

The invention claimed is:

1. A rotation device, comprising:

(a) a housing with a central, substantially axial first medium passage and at least one substantially axial second medium passage;

(b) a rotor shaft which extends in the housing and outside the housing and which is rotatably mounted relative to the housing and supports a rotor accommodated in the housing, which rotor branches with a central third medium passage into a number of angularly equidistant rotor channels, each extending in a respectively at least more or less flat main plane perpendicular to the rotation axis of the rotor from the third medium passage to a respective fourth medium passage, wherein the end zone of the third medium passage and the end zone of the fourth medium passage each extend in a substantially axial direction and each rotor channel has a curved form, and has a middle part which extends in a direction with at least a considerable radial component, and each rotor channel has a flow tube cross-sectional area, which increases at least four-fold in the direction from the third medium passage to the fourth medium passage;

(c) a stator accommodated in the housing, comprising:

a first central body which has a substantially rotation-symmetrical, curved or hybrid formed outer surface with a smooth form which, together with an inner surface of the housing, bounds a at least one generally substantially rotation-symmetrical medium passage space with a radial dimension of a maximum of 0.4 times a radius of said outer surface;

wherein said at least one medium passage space has, at a first end zone directed toward the rotor, at least one fifth medium passage and at a second end zone at least one sixth medium passage in a substantially axial direction;

wherein said at least one fifth medium passage connects for medium flow in a substantially axial direction to the fourth medium passages and is placed at substantially the same radial positions, and which said at least one sixth medium passages is connected to the at least one second medium passage;

a second central body connecting to the first central body, wherein between the sixth medium passage and the at least one second medium passage there extends at least one manifold channel extending in the direction from the sixth medium passages to the at least one second medium passage and bounded by an outer surface of the second central body and the inner surface of the housing;

wherein a general medium throughflow path is defined between the first medium passage and the at least one second medium passage through respectively the first medium passage, the third medium passages, the rotor channels, the fourth medium passages, the at least one fifth medium passages the at least one medium passage space, the at least one sixth medium passage, the at least one manifold channel, the at least one second medium passage, and vice versa, with substantially smooth and continuous transitions between said parts during operation;

wherein the structure is such that during operation there is a mutual force coupling between the rotation of the rotor, and thus the rotation of the shaft, on the one hand and the pressure in the medium flowing through said medium throughflow path;

wherein the rotor comprises two rotation-symmetrical dishes, a first dish adjoining the first medium passage and a second dish disposed at a position remote from the first medium passage, wherein the two dishes, together with baffles also serving as spacers, bound the rotor channels, the axes of said dishes coinciding with the rotation axis of the rotor;

wherein the dishes and the baffles consist of sheet material; and wherein the second dish is stiffened by stiffening means which comprise:

a first stiffening plate extending in a plane perpendicular to the axis of the rotor, which stiffening plate is connected in a tensively strong manner on one side to the rotor shaft and on the other side to the outer peripheral edge of the second dish extending in at least a more or less axial direction; and a shoring structure connected on one side to the rotor shaft and on the other to a middle part of the second dish, this middle part extending with at least a considerable radial component;

wherein, the first stiffening plate in its peripheral edge zone has an annular widening, of which the outer surface located radially furthest outward is connected rigidly to the inner surface of the second dish such that the stiffness of the peripheral edge of the dish is increased.

2. The device as claimed in claim 1, wherein the first stiffening plate branches in its peripheral edge zone into at least two rings which, with at least two respective bent peripheral edges substantially over the whole outer surfaces thereof, are rigidly connected to the inner surface of the peripheral edge of the second dish.

3. The device as claimed in claim 2, wherein the peripheral edges of the least two rings at least substantially connect to each other.

4. The device as claimed in claim 2, wherein one ring forms part of a first plate;

a further ring forms part of or is connected to at least one second plate; and the first and the at least one second plate are disposed together as a package.

5. The device as claimed in claim 2, wherein the rings are formed, placed and connected to the peripheral edge of the second dish such that the centrifugal forces occurring during rotation of the rotor are not sufficient to elastically deform the curved peripheral edge of the second dish to any substantial extent.

6. The device as claimed in claim 1, wherein the shoring structure comprises:

a second stiffening plate extending in a plane perpendicular to the axis of the rotor, wherein the second stiffening plate is connected in a tensively strong manner on one side to the rotor shaft and on the other side to the middle part, extending with a considerable radial component, of the second dish.

7. The device as claimed in claim 6, wherein the first stiffening plate, the second stiffening plate, a truncated conical dish, or any combination thereof is clamped with a central zone between two clamping rings coupled to the rotor shaft.

8. The device as claimed in claim 7, wherein the clamping rings have a radially outward narrowing form, in the manner of a Laval construction.

9. The device as claimed in claim 8, wherein the first stiffening plate, the second stiffening plate, or both are clamped between the clamping rings via round discs which are situated on both sides of the stiffening plate and which have a greater diameter than a plurality of clamping jaws, in the manner of a Laval construction.

10. The device as claimed in claim 7, wherein the first stiffening plate, the second stiffening plate, or both are clamped via a truncated conical inner zone between two correspondingly formed annular clamping surfaces of the clamping rings.

11. The device as claimed in claim 10, wherein an annular zone at the position of the transition between a flat part of the clamping surface and a truncated conical part of the clamping surface having an angle between 90° and 180° is provided with an annular recess.

12. The device as claimed in claim 7, wherein the clamping rings are pressed with force toward each other by means of a screw connection coaxial to the rotation axis of the rotor.

13. The device as claimed in claim 12, wherein the screw connection comprises two co-acting conical screw threads.

14. The device as claimed in claim 6, wherein each dish or each dish part, optionally together with the second stiffening plate, is manufactured by deep-drawing.

15. The device as claimed in claim 14, wherein each dish consists of two parts, a middle part and a peripheral part connected thereto via a circular joint.

16. The device as claimed in claim 15, wherein the peripheral part is formed integrally with the second stiffening plate and the joint is situated in a transition zone between the peripheral part and the second stiffening plate.

17. The device as claimed in claim 6, wherein each dish or each dish part is manufactured by successively performing the following steps of:

(a) providing a plate of metal with the form of a flat ring from which is missing a segment bounded by two complementary edges extending in radial direction;

(b) welding these two edges to each other such that a truncated cone of sheet metal is created, the half-apex angle of which is roughly equal to the angle of inclination of the dish or the dish part in the region around the half radius of the dish;

(c) providing a mould, of which the complementary mould parts to be urged with force toward each other each have a form roughly corresponding to the desired form of the dish or the dish part;

(d) placing the truncated cone in the opened mould;

(e) pressing the mould parts with force toward each other with elastic and plastic deformation of the truncated cone such that a dish or dish part is obtained of the desired form;

(f) opening the mould; and (g) removing the obtained dish or the dish part.

18. The device as claimed in claim 6, wherein each dish or each dish part together with the second stiffening plate, is manufactured by successively performing the following steps of:

(a) providing a plate of metal with the form of a flat ring from which is missing a segment bounded by two complementary edges extending in radial direction;

(b) welding these two edges to each other such that a truncated cone of sheet metal is created, the half-apex angle of which is roughly equal to the angle of inclination of the dish or the dish part in the region around the half radius of the dish;

(c) providing a mould, of which the complementary mould parts to be urged with force toward each other each have a form roughly corresponding to the desired form of the dish or the dish part;

(d) placing the truncated cone in the opened mould;

(e) pressing the mould parts with force toward each other with elastic and plastic deformation of the truncated cone such that a dish or dish part, together with a second stiffening plate, is obtained of the desired form;

(f) opening the mould; and (g) removing the obtained dish or the dish part, together with the second stiffening plate.

19. The device as claimed in claim 1, wherein the shoring structure comprises:

a substantially truncated conical dish which is connected in a tensively strong manner on one side to the rotor shaft and on the other side to the middle part of the second dish, and extends from an inner zone of the first stiffening plate, and is connected rigidly with a bent peripheral edge to an inner surface of the middle part of the second dish over substantially the whole surface of this peripheral edge.

20. The device as claimed in claim 19, wherein the attachment of a second stiffening plate and the peripheral edge of the truncated conical stiffening dish are mutually adjacent in the region of the middle part of the second dish.

21. The device as claimed in claim 1, wherein the dishes are formed from metal by deep-drawing, rolling, forcing, hydroforming, explosive deformation, by means of a rubber press, machining, casting, injection moulding, or a combination of at least two thereof.

22. The device as claimed in claim 1, wherein the dishes are formed from plastic by injection moulding, thermoforming, or thermovacuum-forming which plastic can optionally be reinforced with tensively strong fibres.

23. The device as claimed in claim 1, wherein the dishes are manufactured from sheet-metal which is laid in at least two layers one over the other in a mould with a mould cavity having a form corresponding to the desired form of the rotor, between which two layers medium under pressure is admitted to cause expanding of the sheet material during plastic deformation against the wall of said mould cavity for forming of the rotor.

24. A device as claimed in claim 1, which rotation device is embodied as pump, and the rotor has in the region of the first medium passage an infeed propeller or inducer which comprises a number of double-curved blades.

25. A device as claimed in claim 1, wherein the device is embodied as pump, and wherein the rotor comprises at least two pairs of goblet-shaped dishes placed in nested relation, each of which dishes is connected in a tensively strong and stiff manner to an adjacent dish.

* * * * *

UNITED STATES PATENT AND TRADEMARK OFFICE

CERTIFICATE OF CORRECTION

PATENT NO. : 9,074,608 B2
APPLICATION NO. : 12/936006
DATED : July 7, 2015
INVENTOR(S) : Augustinus Wilhelmus Maria Bertels It is certified that error appears in the above-identified patent and that said Letters Patent is hereby corrected as shown below:

Title Page, Column 2, Assistant Examiner, Line 1, delete "Fyan" and insert -- Ryan --

In the Claims

Column 19, Line 17, Claim 1, delete "passages" and insert -- passage --

Column 19, Line 31, Claim 1, delete "passages" and insert -- passage --

Signed and Sealed this
Nineteenth Day of July, 2016

Michelle K. Lee

Michelle K. Lee
*Director of the United States Patent and Trademark Office*